US007027018B2

(12) United States Patent
Nitta et al.

(10) Patent No.: US 7,027,018 B2
(45) Date of Patent: Apr. 11, 2006

(54) DISPLAY DEVICE AND DRIVING METHOD THEREOF

(75) Inventors: Hiroyuki Nitta, Fujisawa (JP); Nobuyuki Koganezawa, Chiba (JP); Nobuhiro Takeda, Mobara (JP); Tsutomu Furuhashi, Yokohama (JP); Masashi Nakamura, Chosei (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 225 days.

(21) Appl. No.: 10/391,787

(22) Filed: Mar. 20, 2003

(65) Prior Publication Data

US 2004/0001054 A1 Jan. 1, 2004

(30) Foreign Application Priority Data

Mar. 20, 2002 (JP) ..... 2002-077497

(51) Int. Cl.
*G09G 3/36* (2006.01)

(52) U.S. Cl. ..... 345/87; 345/99; 345/213

(58) Field of Classification Search ..... 345/87, 345/99, 213

See application file for complete search history.

(56) References Cited

U.S. PATENT DOCUMENTS

2003/0090449 A1 5/2003 Arimoto et al.

FOREIGN PATENT DOCUMENTS

| | | |
|---|---|---|
| JP | 02-211784 | 8/1990 |
| JP | 05-073005 | 3/1993 |
| JP | 6-16223 | 3/1994 |
| JP | 7-44670 | 5/1995 |
| JP | 10-232662 | 9/1998 |
| JP | 11-109921 | 4/1999 |
| JP | 2001-166280 | 6/2001 |
| JP | 2002-229004 | 8/2002 |

OTHER PUBLICATIONS

"A Black Stripe Driving Scheme for Displaying Motion Pictures on LCDs" Nose et al., SID 01 Digest, pp 994-997.

*Primary Examiner*—Sumati Lefkowitz
*Assistant Examiner*—Ke Xiao
(74) *Attorney, Agent, or Firm*—Antonelli, Terry, Stout and Kraus, LLP.

(57) ABSTRACT

A hold-type display device for eliminating blurring without damaging the display brightness of moving images. The display device includes a pixel array including a plurality of pixels, a plurality of first signal lines, a plurality of second signal lines, a first driving circuit outputting scanning signals to the plurality of first signal lines, and a second driving circuit outputting display signals to the plurality of second signal lines. The first driving circuit repeats a step for sequentially selecting the first signal lines every Y lines for every N times and a step for selecting the first signal lines every Z lines for every M times which follows the N times. The second driving circuit repeats outputting N times the display signals and outputting M times a blanking signal which masks an image displayed on corresponding pixels.

16 Claims, 6 Drawing Sheets

DISPLAY DEVICE AND DRIVING METHOD THEREOF

BACKGROUND OF THE INVENTION

1. Field of the Invention

The present invention relates to a so-called active matrix-type display device represented by a liquid crystal display device provided with a plurality of pixels which respectively have switching elements, an electro-luminescence-type display device or a display device provided with a plurality of pixels which respectively have light emitting elements such as light emitting diodes, and more particularly to a blanking process of a display image in a hold-type display device.

2. Description of the Related Art

A liquid crystal display device has been popularly used as a display device in which images based on image data (video signals in case of television broadcasting) inputted from outside in accordance with every frame period are displayed by holding respective brightness of a plurality of pixels which are arranged two-dimensionally at a desired value within a given period (1 frame period, for example).

In the liquid crystal display device adopting an active matrix scheme, as shown in FIG. 9, pixel electrodes PX and switching elements (thin film transistors) SW which supply video signals to these pixel electrodes PX are formed on a plurality of respective pixels PIX which are arranged two dimensionally or in a matrix array. A die on which a plurality of pixels PIX are arranged is also referred to as a pixels array 101, wherein the pixels array in the liquid crystal display device is also referred to as a liquid crystal display panel. In this pixels array, a plurality of pixels PIX constitute a so-called screen which displays images.

In the pixels array 101 shown in FIG. 9, a plurality of gate lines 10 (also referred to as scanning signal lines) which extend in the lateral direction and a plurality of data lines 12 (also referred to as video signal lines) which extend in the longitudinal direction (the direction which crosses the gate lines 10) are juxtaposed respectively. As shown in FIG. 9, along the respective gate lines 10 which are respectively discriminated by addresses consisting of G1, G2, . . . Gj, Gj+1 . . . Gn, so-called pixel rows in which a plurality of pixels PIX are arranged in the lateral direction are formed. On the other hand, along the respective data lines 12 which are discriminated by addresses consisting of D1R, D1G, D1B . . . DmB, so-called pixel columns in which a plurality of pixels PIX are arranged in the longitudinal direction are formed. The gate lines 10 apply voltage signals which are supplied from a scanning driver 103 (also referred to as a scanning driving circuit) to the switching elements SW provided to the respective pixels PIX which constitute the pixel rows (arranged below the respective gate lines in the case shown in FIG. 9) which respectively correspond to the gate lines 10, and open or close the electrical connection between the pixel electrode PX mounted on each pixel PIX and one of data lines 12. An operation to control a group of switching elements SW provided to the specific pixel row by applying voltage signals to the group from the gate lines 10 which correspond to the group is also referred to as "selecting line(s)" or "scanning". The above-mentioned voltage signals applied to the gate lines 10 from the scanning driver 103 are also referred to as scanning signals and, for example, control the conductive state of the switching elements SW in response to pulses generated in signal waveforms thereof. Further, in response to kinds of switching elements SW, the scanning signals are supplied to the scanning signal lines (corresponding to the gate lines 10) as current signals.

On the other hand, to the respective data lines 12, display signals (voltage signals in case of the liquid crystal display device) which are referred to as gray scale voltages (or tone voltages) are applied from a data driver (also referred to as video signal driving circuit) 102. The above-mentioned gray scale voltages are applied to the respective pixel electrodes PX selected by the above-mentioned scanning signals on the pixels PIX which constitute the pixel columns (right side of respective data lines 12 in case of FIG. 9) which correspond to respective display signals.

When such a liquid crystal display device is incorporated into a television set, with respect to 1 field period of video data (for video signals) received by an interlace mode or with respect to 1 frame period of video data received in a progressive mode, the above-mentioned scanning signals are sequentially applied to the gate lines 10 in the order from the addresses G1 to Gn, and the gray scale voltages generated based on video data received during 1 field period or 1 frame period are sequentially applied to a group of pixels which constitute the respective pixel rows. In each pixel, a so-called capacitive element is formed by sandwiching a liquid crystal layer LC between the above-mentioned pixel electrode PX and a counter electrode CT to which a reference voltage or a common voltage is applied through a signal line 11 and the light transmissivity of the liquid crystal layer LC is controlled based on an electric field generated between the pixel electrode PX and the counter electrode CT. As mentioned above, when the operation to sequentially select the gate line G1 to the gate line Gn is performed one time in accordance with every field period or every frame period of the video data, for example, the gray scale voltage applied to the pixel electrode PX of a certain pixel during a certain field period is theoretically held in the pixel electrode PX until the pixel electrode PX receives another gray scale voltage in the next field period which follows the certain field period. Accordingly, the light transmissivity of the liquid crystal layer LC sandwiched between the pixel electrode PX and the above-mentioned counter electrode CT (in other words, brightness of the pixel which includes this pixel electrode PX) is held in a given state in accordance with 1 field period. The liquid crystal display device which displays images by holding the brightness of the pixel in accordance with every field period or in accordance with every frame period is also referred to as a hold-type display device. This hold-type display device is classified from a so-called impulse-type display device such as a cathode-ray tube which illuminates phosphors provided to respective pixels by the irradiation of electron beams at the moment that the device receives video signals.

Video data which is transmitted from a television receiver set or, a computer or the like has a format corresponding to the impulse-type display device. To compare a driving method of the above-mentioned liquid crystal display device with television broadcasting, the scanning signals are applied for every gate line 10 within a time which corresponds to the inverse number of horizontal scanning frequency of the television broadcasting and the applying of scanning signals to the whole gate lines G1 to Gn is completed within time corresponding to the inverse number of the vertical frequency. Although the impulse-type display device sequentially illuminates the pixels which are arranged in the lateral direction on the screen like impulses in accordance with every horizontal scanning period in response to horizontal synchronizing pulses, the hold-type display device, as mentioned above, selects the pixel rows in accordance with horizontal scanning period and supplies the voltage signals simultaneously to a plurality of pixels included in the pixel row and holds the voltage signals to these pixels after the completion of the horizontal scanning period.

Although the manner of operation of the hold-type display device has been explained by taking the liquid crystal display device as an example in conjunction with FIG. 9, an electro-luminescence type (EL type) display element which replaces the liquid crystal layer LC with an electro-luminescence material or a light-emitting diode array type display device which replaces the capacitive element sandwiching the liquid crystal layer LC between the pixel electrode PX and the counter electrode CT with a light emitting diode is also operated as the hold-type display device although they differ in an operation principle (images being displayed by controlling a carrier injection amount into a light emitting material). In the display device which generates images by injecting the carrier into the light emitting material (light emitting regions), the above-mentioned display signals are supplied to respective pixels within the pixels array as current signals.

Here, the hold-type display device displays images by holding the respective brightness of the pixels in accordance with the above-mentioned every frame period, for example. Accordingly, when the display image is replaced with another display image between a pair of continuing frame periods, there arises a case that the brightness of the pixel does not sufficiently respond. This phenomenon is explained such that the pixel which is set to a given brightness during a certain frame period (first frame period, for example) holds the brightness corresponding to the first frame period until the pixel is scanned in the next frame period (second frame period, for example). Further, this phenomenon can be also explained in view of a so-called hysteresis of video signals of respective pixels. That is, a portion of the voltage signal (or carrier injected to the voltage signals) which is transmitted to the pixel within the first frame period interferes with the voltage signal (or carrier to be injected to the voltage signal) to be transmitted to the pixel during the second frame period. Techniques which solves such problems related with responsiveness of the image display in the display device using the hold-type light emitting are disclosed in Japanese Accepted Patent Publication 016223/1994, Japanese Accepted Patent Publication 044670/1995, Japanese Laid-open Patent Publication 073005/1993, Japanese Laid-open Patent Publication 109921/1999 and Japanese Laid-open Patent Publication 166280/2001 respectively.

Among these publications, Japanese Laid-open Patent Publication 109921/1999 discusses a so-called blurring phenomenon in which when moving images are reproduced using a liquid crystal display device (an example of a display device using hold-type light emitting), a profile of an object becomes indefinite compared to a cathode ray tube which illuminates pixels as impulses. To solve such a blurring phenomenon, Japanese Laid-open Patent Publication 109921/1999 discloses a liquid crystal display device in which a pixels array (a group of a plurality of pixels which are arranged two dimensionally) of one liquid crystal display panel is divided into upper and lower portions of a screen (image display area) and data line driving circuits are respectively provided to the divided upper and lower pixels arrays. The liquid crystal display device performs a so-called dual scanning operation in which one gate line is selected from each one of upper and lower pixels arrays, that is, two gate lines in total with respect to the upper and lower pixels arrays are selected and video signals are supplied from data line driving circuits formed on the respective pixels arrays. While performing this dual scanning operation within 1 frame period, a vertical phase between upper and lower pixels arrays is shifted such that signals corresponding to display images (so-called video signals) are inputted to one pixels array from one data line driving circuit and signals of blanking images (black images, for example) are inputted to the other pixels array from the other data line driving circuit. Accordingly, a period for performing the video display and a period for performing the blanking display are applied to both of the upper and lower pixels arrays during 1 frame period so that a period in which the videos are held over the whole screen can be shortened. Accordingly, the liquid crystal display device can also obtain the moving image display function comparable to that of the cathode ray tube.

That is, as the conventional technique, Japanese Laid-open Patent Publication 109921/1999 discloses a technique in which one liquid crystal display panel is divided into two upper and lower pixels arrays, the data line driving circuits are respectively formed on the divided pixels arrays, two gate lines in total consisting of one gate line for the upper pixels array and one gate line for the lower pixels array are selected so as to perform the dual scanning of the upper and lower display regions divided in halves using respective driving circuits, and the blanking images (black images) is interpolated by shifting the vertical phase within 1 frame period. That is, 1 frame period can take the state of the video display period and the state of blanking period so that the video holding period can be shortened. Accordingly, with the use of the liquid crystal display, it is possible to obtain the moving image display function of the impulse-type light emitting as in the case of the cathode ray tube.

On the other hand, another technique which suppresses a blurring phenomenon of moving images displayed by a liquid crystal display device is disclosed in Japanese Laid-open Patent Publication 166280/2001. This publication discloses a driving method of a liquid crystal display device. In this driving method, a period for selecting gate lines for supplying video signals to a group of pixels corresponding to respective gate lines is divided, wherein to a group of pixels corresponding to the gate lines selected in the former half of the selection period, video signals are supplied, while to another group of pixels which correspond to another gate lines selected in the latter half, voltage signals which perform a black display of such another group of pixels are supplied. The summary of this driving method of the liquid crystal display device is explained in conjunction with an example in which the pixels array shown in FIG. 9 is driven in accordance with a timing chart shown in FIG. 10. In accordance with every frame period, the gate lines G1, G2, . . . Gj, . . . Gj+1 in the pixels array 101 are respectively selected in response to gate pulses (also referred to as gate selection pulses) generated by scanning signals transmitted from the scanning driver 103. In other words, the switching element SW which is provided to each pixel PIX corresponding to the gate line which receives the gate pulse assumes a state in which a display signal O-DDR transmitted from the data line 12 in response to the gate pulse is received by the pixel PIX. For example, in response to outputting from the data driver 102 of the display signal L1 generated by one line of the video data to be supplied to a group of pixels (also referred to as pixel rows since pixels are arranged in a row direction) corresponding to the gate line G1, the gate line G1 is selected in response to the gate pulse. FIG. 10 indicates a gate pulse as a waveform which makes the scanning signal of Low state shifted to High state, wherein over a period in which the scanning signal assumes the High state, the gate line which receives this scanning signal is selected.

In a driving method of a liquid crystal display device disclosed in Japanese Laid-open Patent Publication 166280/2001, to supply a display signal (any one of L1, L2, Lj, Lj+1, . . . in FIG. 10) corresponding to one line of video data to respective pixel rows, out of time tg which selects the gate line (G1, G2, Gj, Gj+1 in FIG. 10) corresponding to the display signal, a time tb which constitutes the latter half is allocated to the selection of a separate gate line (gate line Gj with respect to the gate line G1) and a display signal (B in FIG. 10) which displays a pixel row corresponding to the separate gate line in black is supplied to the pixel row. The gate line which is selected within a time (tg–tb) and in which the video data for one line is written and the gate line which is selected within time tb and in which black data (corresponding to display signals which displays pixels in black) is written are selected such that they are spaced apart from each other in the pixels array. Due to such a constitution, by completing the formation of images due to writing of video data into the pixels array and the cancellation of images in accordance with every frame period, the images are formed on a screen in the same manner as an impulse-type display device and the blurring of moving images can be reduced.

To compare the liquid crystal display device described in the above-mentioned Japanese Laid-open Patent Publication 109921/1999 and the liquid crystal display device described in the above-mentioned Japanese Laid-open Patent Publication 166280/2001, the former can selects two gate lines simultaneously and supplies the display signal corresponding to the video data for one line to the pixel row corresponding to one gate line and the display signal which displays the pixel row corresponding to the other gate line in black to the other pixel row. Due to such a constitution, it is possible to ensure time for supplying the display signal to respective pixels which constitute respective pixel rows. However, in one frame period, a period in which the pixel row holds the display signal corresponding to the video data is limited to one half of the frame period. Accordingly, in particular, when the delay time is necessary for the brightness of the pixel to reach a value corresponding to the display signal from the supply of the display signal, there arises a problem that the display device receives a next display signal which displays the pixel in black before the pixel acquires the sufficient brightness. To solve this problem, it is necessary to increase the intensity of the display signal and this inevitably necessitates the increase of the output of the data driver 102. Further, as mentioned above, in the liquid crystal display device described in Japanese Laid-open Patent Publication 109921/1999, the pixels array is divided into two regions and hence, it is inevitably necessary to provide data line driving circuits respectively. Accordingly, the liquid crystal display panel and circuits in the periphery of the liquid crystal display panel naturally become complicated and large-sized.

On the other hand, the liquid crystal display device described in Japanese Laid-open Patent Publication 166280/2001 is more practical than the liquid crystal display device described in Japanese Laid-open Patent Publication 109921/1999 in view of the structure and size of the liquid crystal display panel and peripheral circuits thereof. However, as can be clearly understood from a timing chart in FIG. 10, a portion of the gate line selection period for writing the video data for one line to the pixel row is allocated to the selection of the separate gate line for writing black data to the separate pixel row and hence, the presence of the problem that a time for supplying the display signals to respective pixel rows becomes short cannot be denied. In SID 01 Digest (The 2001 International Symposium of the Society for Information Display), pages 994 to 997, a technique which can solve the above-mentioned problem of the liquid crystal display device in Japanese Laid-open Patent Publication 166280/2001 is described. To explain this technique in conjunction with FIG. 10, the ratio of the time tb with respect to the time tg is suppressed to tg/2 so as to ensure the video data writing time to the pixel rows. On the other hand, the black data writing to the pixel rows is repeated in response to the video data writing to the pixel rows in plural times so as to replenish the shortage of the writing time tb for one time. Accordingly, the writing of black data to the gate lines Gj, Gj+2, Gj+4, . . . (latter two not shown in FIG. 10) with respect to the writing of the video data to the gate line G1 and the writing of black data to the gate lines Gj+1, Gj+3, Gj+5, . . . (latter two gate lines not shown in FIG. 10) with respect to the writing of the video data to the gate line G2 are respectively performed.

In this manner, although the black data writing time to the gate lines can be ensured as a sum of writing times, the shortage of time for every black data writing is insufficient to compensate for the delay of brightness response of the pixel. That is, compared to the pixel which receives the sufficient display signal in the black data writing to the gate line at a time, the pixel which receives the display signal divided in a plural times exhibits the slow brightness response. Accordingly, the display signal of video data to be erased remains in the pixel even after the writing of black data is started and hence, the possibility that the erasure of image based on the video data from the screen which is to be completed in one frame period becomes unfinished to the contrary cannot be denied.

It is an object of the present invention to provide a display device and a method for driving the display device which can suppress a blurring phenomenon of moving images displayed on the display device and can sufficiently hold the display brightness while minimizing the structural change of a periphery of pixels array of a hold-type display device represented by a liquid crystal display device.

SUMMARY OF INVENTION

One example of a display device according to the present invention comprises (1) a pixels array in which a plurality of pixels each of which includes a switching element (for example, a field-effect element such as a thin film transistor) are arranged forming a plurality of pixel rows in the first direction (for example, in the horizontal direction of a display screen) and a plurality of pixel columns in the second direction (for example, a vertical direction in the display screen) which crosses the first direction; (2) a plurality of first signal lines (for example, scanning signal lines) which extend along the first direction of the pixels array and are arranged in parallel along the second direction, each first signal line capable of transmitting a first signal (for example, a gate pulses) to a group of switching elements provided to the pixel row corresponding to the first line; (3) a first driving circuit (for example, a scanning driving circuit) capable of sequentially transmitting the first signal to a plurality of respective first signal lines from one end to the other end of the pixels array in the second direction and thereby selecting the pixel rows corresponding to respective first signal lines; (4) a plurality of second signal lines (for example, video signal lines and data signal lines) which extend along the second direction of the pixels array and are arranged in parallel along the first direction, each second signal line capable of supplying a second signal to at least one pixel which belongs to a group of pixel rows selected by the first signal among the pixels provided to the pixel column corresponding to the second signal line; (5) a second driving circuit (for example, a data driving circuit) capable of outputting the second signal to a plurality of respective second signal lines; and (6) a display control circuit (for example, a timing controller) which transmits a first control signal for controlling outputting of the first signal to the first driving circuit and a second control signal for controlling outputting interval of the second signal and video data to the second driving circuit.

The above-mentioned first driving circuit alternately repeats a first scanning step which outputs the first signal N times to a plurality of first signal lines every Y lines and a second scanning step which outputs the first signal M times to a plurality of first signal lines every Z lines excluding the (Y×N) first signal lines which receive the first signals at the first scanning step (Y, N, Z, M being natural numbers which respectively satisfy relationships $M<N$ and $Y<N/M\leqq Z$.

The second driving circuit receives the video data from the display control circuit every horizontal scanning frequency line by line and repeats N times of outputting of the second signal generated every video data line in the first scanning step and M times of outputting of the second signal which masks the pixels array in the second scanning step.

The above-mentioned video data is inputted to the display device from a video signal source which is arranged outside the display device such as a television receiving set, a personal computer, a DVD player (Digital Versatile Disc Player). Further, with respect to the video data, one line of data (also referred to as line data or horizontal data) is inputted to the display device a plural times every horizontal scanning frequency so as to provide image information of one screen to the display device. The video data is inputted to the display device every image information for one screen. A period necessary for this inputting is referred to as a frame period.

On the other hand, a period necessary for selecting the pixel rows and inputting the display signal to the pixel rows for outputting of display signal from the second driving circuit one time is referred to as a horizontal cycle or a horizontal period. In other words, the horizontal period corresponds to an outputting interval of the second signal from the second driving circuit. By setting are tracing period included in this horizontal period shorter than a horizontal retracing period included in the period for inputting video data for one line to the display device (horizontal scanning period), compared to an inputting interval of the video data for one line to the display device, an outputting interval of the display signal to the pixels array in response to such inputting becomes shorter. Accordingly, by providing at least N pieces of line memories in the display control circuit and by sequentially storing the video data which are sequentially inputted to the display device every one line to every one of N pieces of line memories, by sequentially reading out the video data from respective line memories, the difference between time necessary for inputting the video data for N lines to the display device and time necessary for sequentially (over N times) transferring the video data to the second driving circuit can be utilized for outputting of the second signals to the pixels array in the second scanning step. In the second scanning step, the second signal which masks the pixels array makes the brightness of the pixels to which the second signal is inputted to a level equal to or below the brightness of the pixel before the second signal is inputted and hence, the second signal is also referred to as a blanking signal.

Another example of the display device according to the present invention comprises (1) a pixels array including a plurality of pixels which are arranged two-dimensionally along the first direction (for example, the horizontal direction of a display screen) and the second direction (for example, the vertical direction of the display screen) which crosses the first direction; (2) a plurality of first signal lines (for example, scanning signal lines) being arranged in parallel along the second direction in the pixels array, the plurality of first signal lines transferring scanning signals which select a plurality of pixel rows each of which is formed of a group consisting of a plurality of pixels arranged along the first direction; (3) a plurality of second signal lines (for example, video signal lines) being arranged in parallel to the first direction in the pixel array, the plurality of second signal lines supplying display signals which determine the brightness of the respective pixels contained in the pixel row selected by the scanning signal; (4) a first driving circuit (for example, a scanning signal driving circuit) which outputs the scanning signals to the plurality of respective first signal lines; (5) a second driving circuit (for example, a data driving circuit) which outputs the display signals to the plurality of respective second signal lines; and (6) a display control circuit (for example, a timing controller) capable of transmitting a first clock signal which allows video data to be inputted line by line in response to a horizontal synchronizing signal (for example, defining the above-mentioned horizontal scanning period) every frame period and controls the scanning signal outputting by the first driving circuit and a scanning start signal which instructs the start of a selecting step of the pixel rows in response to the first clock signal to the first driving circuit, and capable of transmitting a second clock signal to the second driving circuit together with the video data.

In this display device, the second driving circuit alternately repeats outputting N times (N being a natural number of 2 or more) of a video display signal generated from the video data for one line in response to the second clock signal every frame period and outputting M times (M being a natural number satisfying $M<N$) of a blanking signal which masks an image displayed on the pixels array.

Further, in this display device, the first driving circuit alternately repeats a step for sequentially selecting the first signal lines from one end to the other end of the pixels array every Y lines ($Y<N/M$) for every N times outputting of video display signal in response to the outputting of the scanning signal every frame period and a step for selecting the first signal lines except for the selected Y×N pieces of first signal lines with respect to N times outputting of the video display signal from one end to the other end of the pixels array every z lines ($Z\geqq N/M$) for every M times outputting of blanking signal which follows the N times outputting of video display signal. A group of Y×N pieces of first signal lines and a group of Z×M pieces of first signal lines which are selected in the respective steps may be spaced apart from each other by sandwiching another first signal lines which belong to neither group within the pixels array. Further, when these groups of signal lines are arranged close to each other, by arranging a group of Y×N pieces of first signal lines and a group of Z×M pieces of first signal lines from one end side of the pixels array in this order, the holding time of video display signals in the pixels corresponding to a group of Y×N pieces of first signal lines is prolonged. That is, the period from a time at which the pixels are selected (receiving the video display signal) by any one of a group of Y×N pieces of first signal lines to a time at which the pixels are selected (receiving the blanking signal) by one of a group of Z×M pieces of first signal lines can be prolonged.

The above-mentioned scanning start signal determines a first time which starts the step for sequentially selecting the first signal lines every Y lines for every frame period from one end of the pixels array and a second time which starts the step for sequentially selecting the first signal lines every Z lines from one end of the pixels array respectively. Further, by setting an interval between the first time and the ensuing second time in one frame period longer than an interval between this second time and an ensuing first time (a time at which the selection of the first signal lines every Y lines in the next frame period starts), a ratio of the time that the pixels array holds the video display signals in one frame period (in other words, the video display period on the screen) is increased and hence, the display brightness is increased.

Further, at least in a pair of continuous frame periods, an interval between a first time and an ensuing second time for the scanning start signal (a timing at which the blanking signal is supplied to the pixels array) may differ in respective frame periods. When the waveform of the scanning start signal includes a first pulse corresponding to the first time and a second pulse corresponding to the second time, at least in a pair of continuous frame periods, an interval between the first pulse and the second pulse in respective frame periods may differ from each other.

Further, to summarize a method for driving a display device comprising (a) a pixels array in which a plurality of pixel rows each of which includes a plurality of pixels arranged in the first direction are arranged in parallel in the second direction which crosses the first direction, (b) a scanning driving circuit which selects the plurality of pixel rows respectively in response to scanning signals, (c) a data driving circuit which supplies display signals to the respective pixels included in at least one pixel row selected from the plurality of pixel rows in response to the scanning signal, and (d) a display control circuit which controls a display operation of the pixels array, it is as follows.

(1) Video data is inputted to the display device line by line every horizontal scanning period thereof.

(2) Using the data driving circuit, (2A) a first step in which for every one line of the video data, the display signals corresponding to the video data are sequentially generated and the display signals are outputted N times (N being a natural number of 2 or more) to the pixels array, and (2B) a second step in which display signals which set the brightness of the pixels to a level equal to or below the brightness of the pixels in the first step (in other words, a level equal to or below the brightness before the pixels receive the display signals in the second step 2B) are generated and the display signals are outputted M times (M being a natural number smaller than N) to the pixels array are alternately repeated.

(3) Using the scanning driving circuit, (3A) a first selection step in which the plurality of pixel rows are sequentially selected every Y rows (Y being a natural number smaller than N/M) from one end to the other end of the pixels array along the second direction in the first step, and (3B) a second selection step in which the plurality of pixel rows except for the pixel rows (Y×N) selected in the first selection step are sequentially selected every Z rows (Z being a natural number equal to or more than N/M) from one end to the other end of the pixels array in the second direction in the second step are alternately repeated.

The above-mentioned step (2A) and the step (3A) as well as the step (2B) and the step (3B) are respectively performed substantially in parallel.

The manner of operation and the advantageous effects of the present invention which have been described heretofore and preferred embodiments thereof will become more apparent in conjunction with explanations described hereinafter.

DESCRIPTION OF THE PREFERRED EMBODIMENTS

Figure 1:
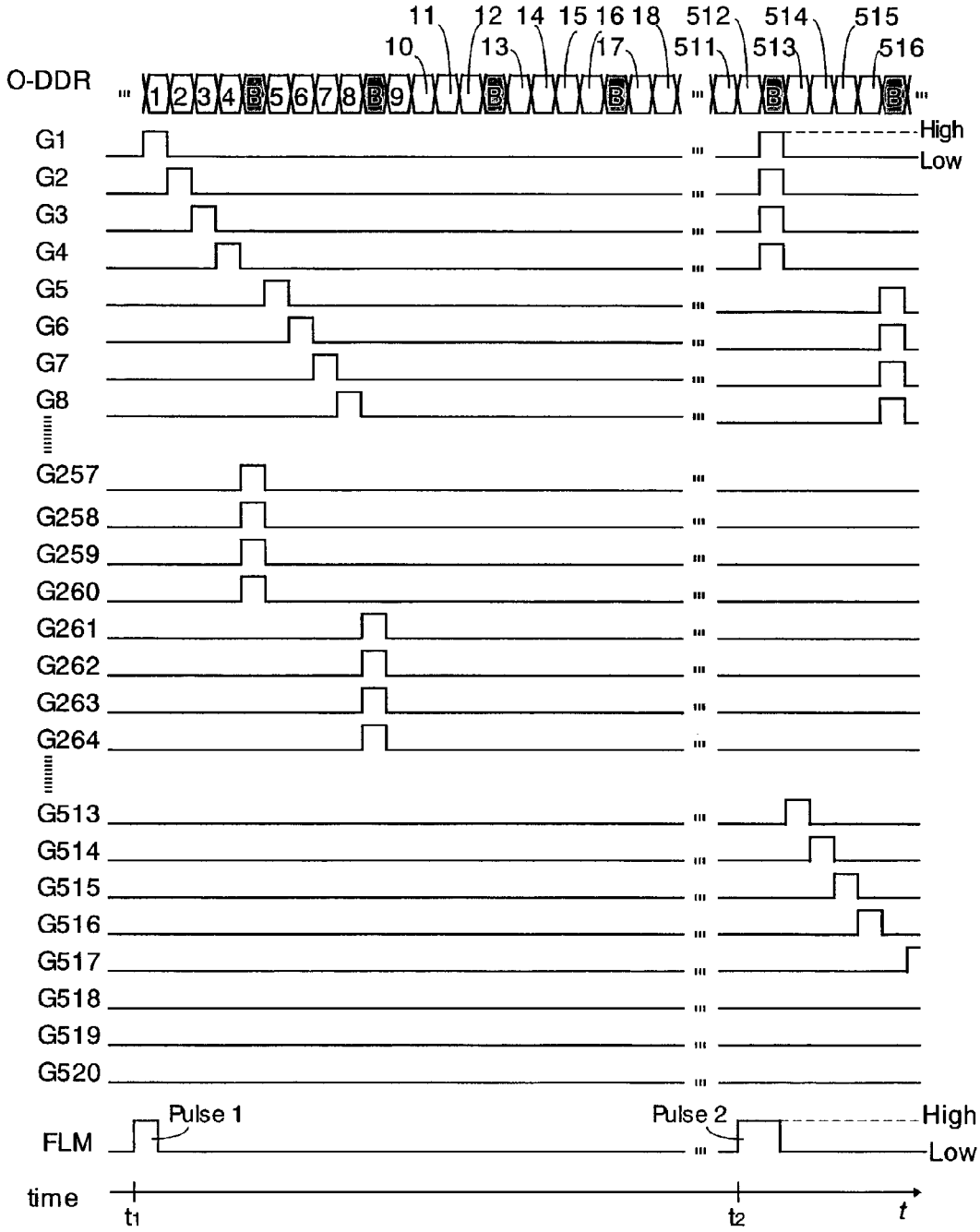
FIG. 1 is a view showing outputting timing of display signals and a driving waveforms of scanning lines corresponding to the output timing explained in conjunction with a driving method of a display device according to the first embodiment of the present invention.

Specific embodiments of the present invention are explained in conjunction with drawings which are relevant to these embodiments. In the drawings which are referred to in the following explanation, parts which have identical functions are given same symbols and their repeated explanation is omitted.

<<First Embodiment>>

A display device and a driving method of the first embodiment of the present invention are explained hereinafter in conjunction with FIG. 1 to FIG. 7. In this embodiment, the explanation is made with respect to a display device (liquid crystal display device) which uses an active matrix type liquid crystal display panel in a pixels array. However, the basic structure and driving method are applicable to a display device which uses an electroluminescence array or a light emitting diode array as a pixels array.

Figure 2:
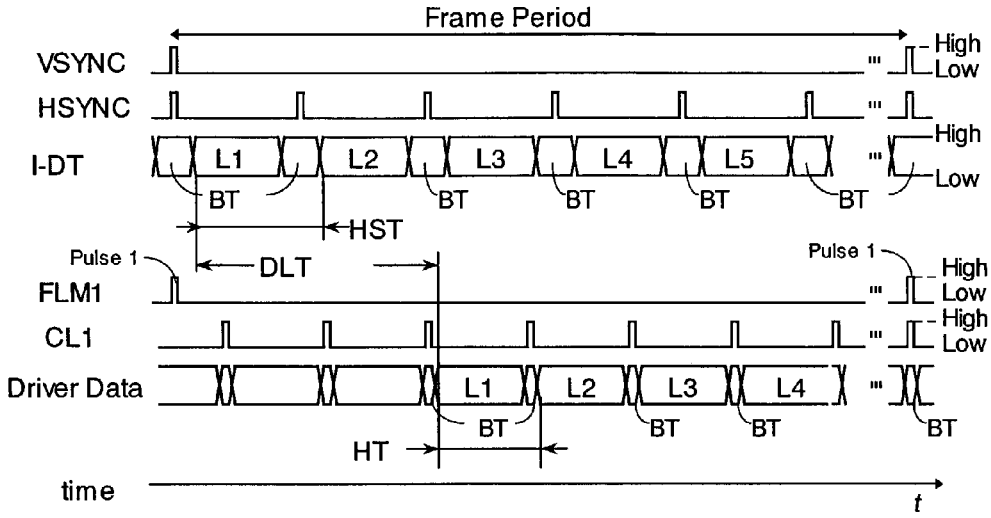
FIG. 2 is a view showing timing between inputting waveforms (input data) of video data to a display control circuit (timing controller) and outputting waveforms (driver data) from the display control circuit in the driving method of the display device according to the first embodiment of the present invention.
Figure 3:
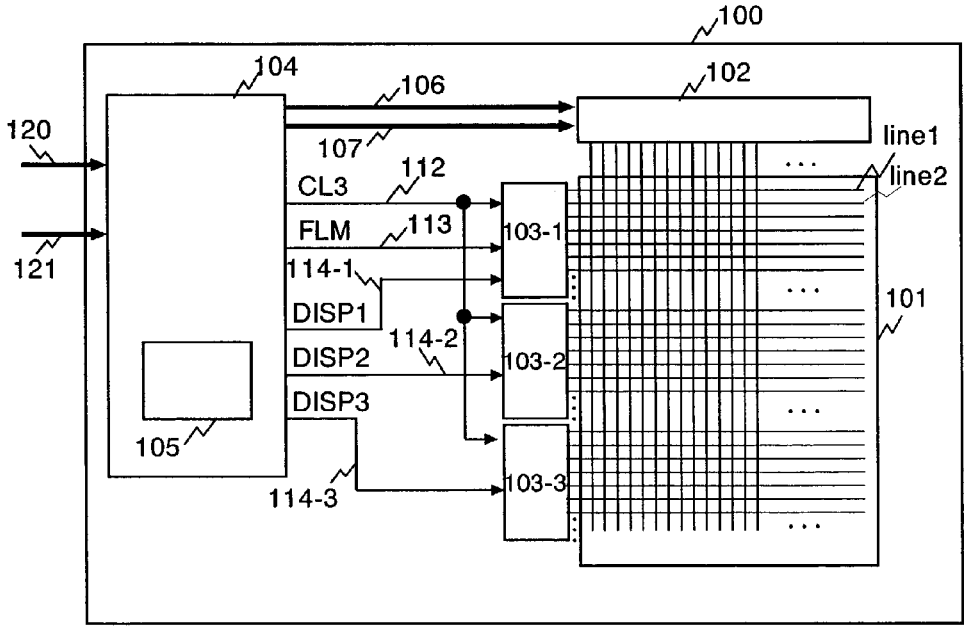
FIG. 3 is a structural view showing the summary of the display device (liquid crystal display device) according to the present invention.
Figure 4:
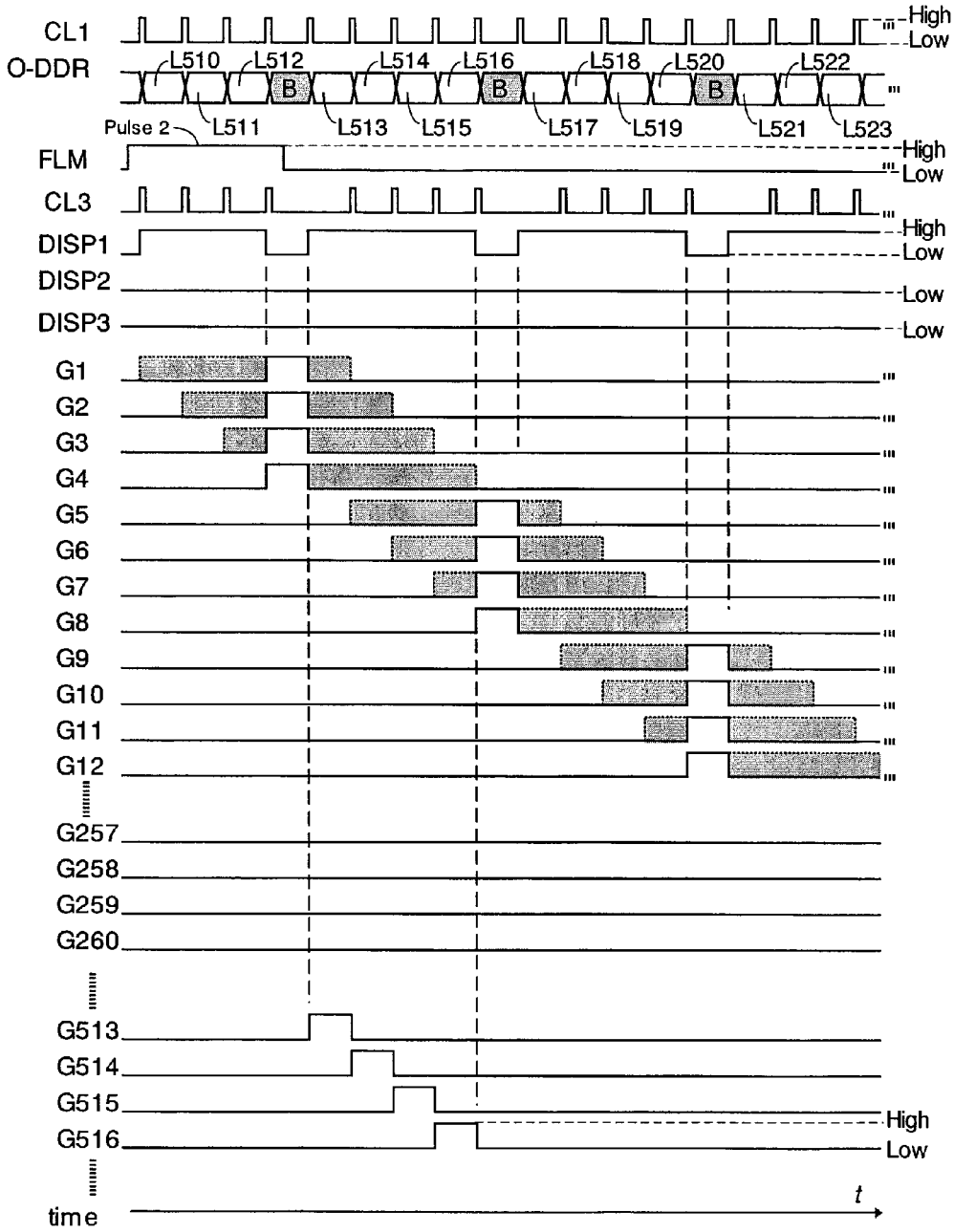
FIG. 4 is a view showing driving waveforms which simultaneously select four lines out of scanning lines during the outputting period of display signals explained in the driving method of the display device according to the first embodiment of the present invention.
Figure 5:
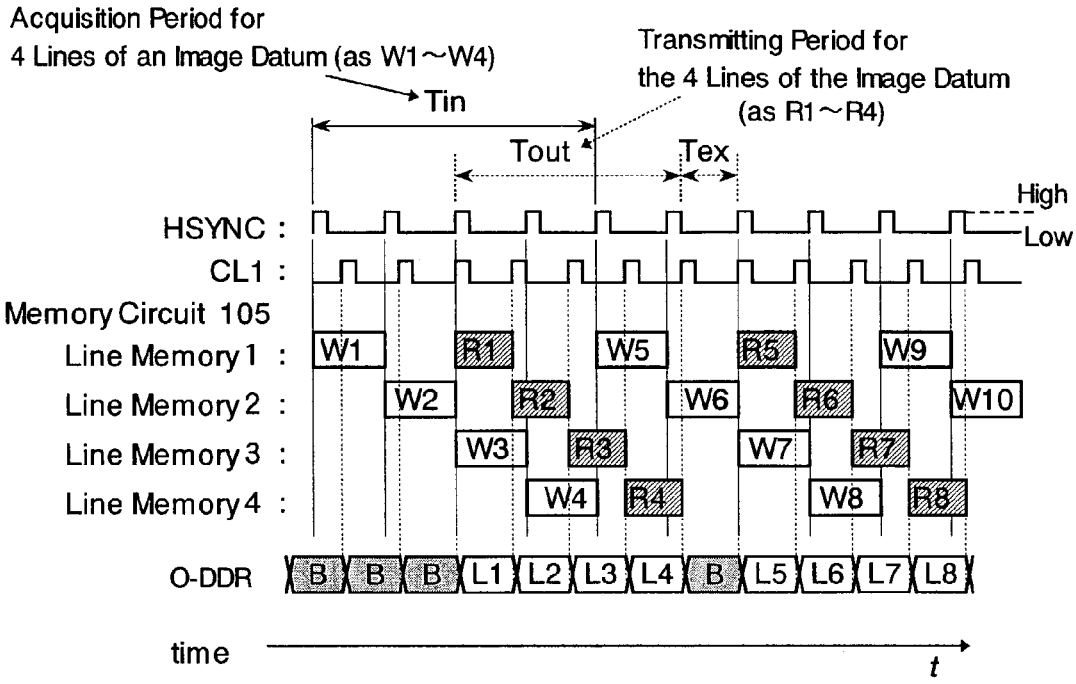
FIG. 5 is a view showing respective timings of writing of video data to a plurality (four pieces, for example) of line memories provided to the display device according to the present invention and timing of reading out the video data from these line memories.
Figure 6:
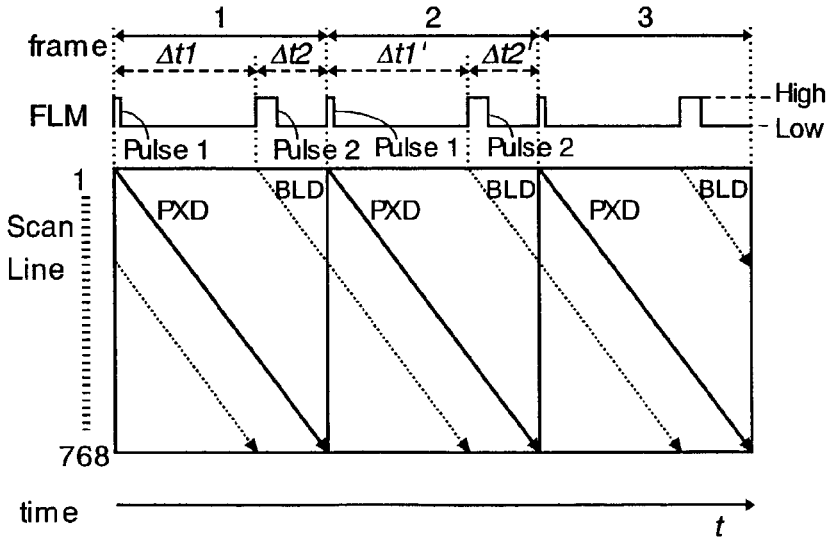
FIG. 6 is a view showing the image display timing of every frame period (each one of three continuous frame periods) in the driving method of the display device according to the first embodiment of the present invention.
Figure 7:
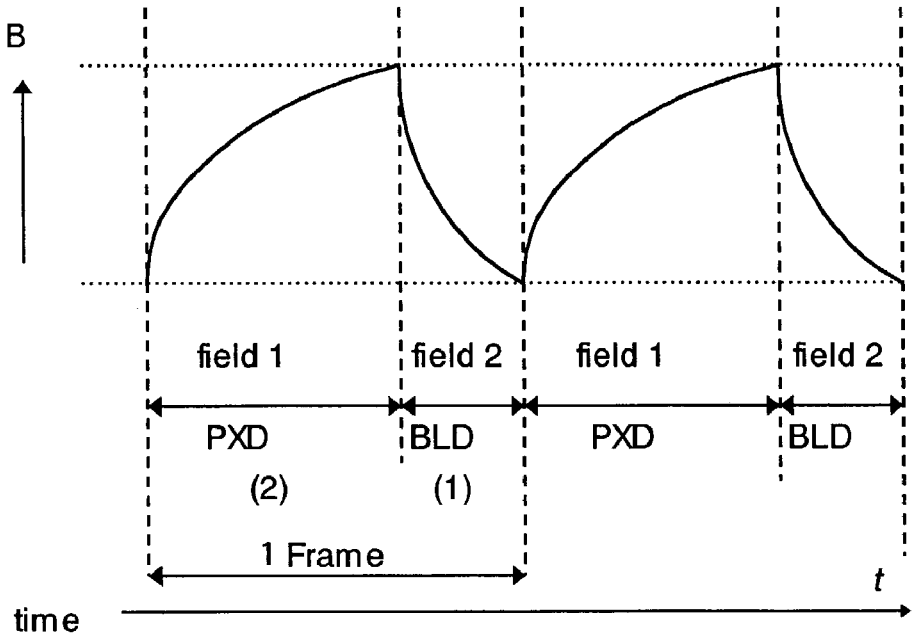
FIG. 7 is a view showing the brightness response of pixels to the display signals (fluctuation of light transmissivity of a liquid crystal layer corresponding to pixels) when the liquid crystal display device (one example of display device) according to the present invention is driven in accordance with image display timing shown in FIG. 6.
Figure 9:
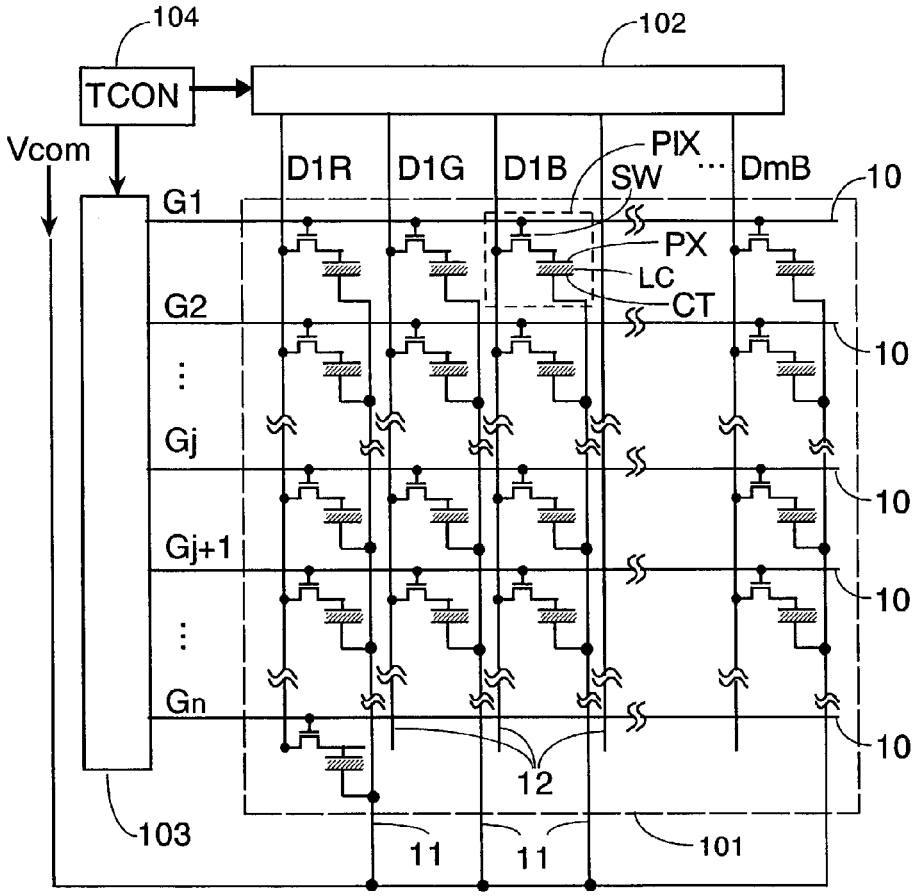
FIG. 9 is a schematic view showing an example of a pixels array provided to an active matrix type display device.
Figure 10:
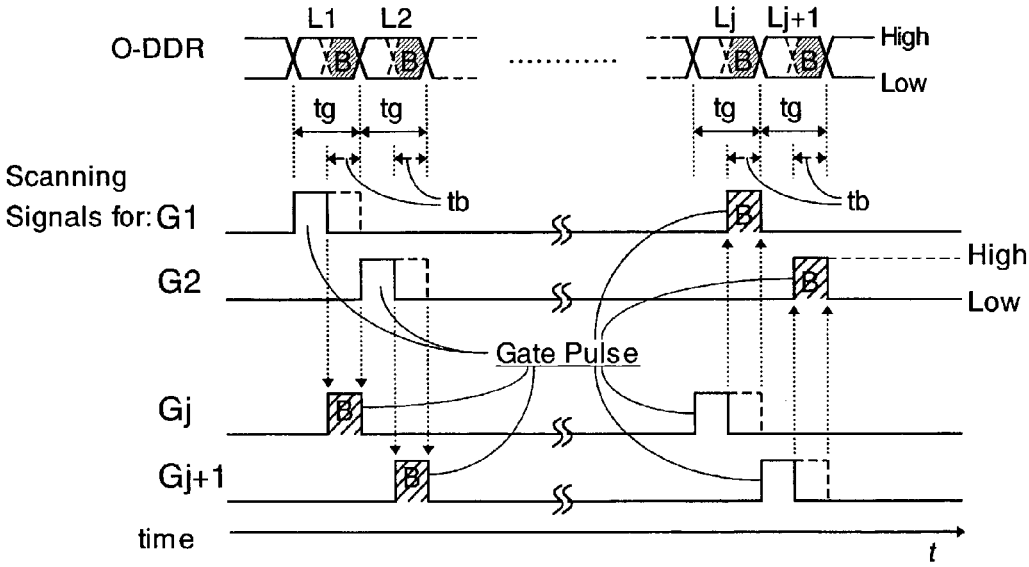
FIG. 10 is a view showing waveforms of scanning signals and display signals in one of conventional techniques for suppressing a blurring phenomenon of moving images in a liquid crystal display device.

FIG. 1 is a timing chart showing the selection timing of display signal outputs (data driver output voltages O-DDR to a pixels array of a display device according to the present invention and scanning signal lines G1 in the pixels array which correspond to respective display signal outputs. FIG. 2 is a timing chart showing the timing between inputs (input data) of video data to a display control circuit (timing controller) provided to the display device and outputs (driver data) of the video data from the display control circuit. FIG. 3 is a constitutional view (block diagram) showing the summary of the display device according to this embodiment of the present invention and one example of the detail of the pixels array 101 and a periphery thereof shown in FIG. 3 is shown in FIG. 9. The previous timing charts shown in FIG. 1 and FIG. 2 are depicted based on the constitution of the display device (liquid crystal display device) shown in FIG. 3. FIG. 4 is a timing chart showing another example of the selection timing between the display signal outputs (data driver output voltages) to the pixels array and the scanning signal lines which respectively correspond to the display signal outputs in the display device according to this embodiment. In the timing chart, during the outputting period of the display signals, four scanning signal lines are selected in response to the scanning signal lines outputted from a shift-register type scanning driver and display signals are supplied to pixel rows which respectively correspond to these scanning signal lines. FIG. 5 is a timing chart which shows timing for writing four lines of video data line by line every four line memories contained in a line-memory circuit 105 provided to a display control circuit 104 (see FIG. 3), reading out the video data from respective line memories and, thereafter, transferring these line memories to a data driver (video signal driving circuit). FIG. 6 relates to the driving method of the display device according to the present invention and shows the display timing of the video data and the blanking data according to the pixels array of this embodiment. The brightness response of pixels when the display device (liquid crystal display device) according to this embodiment is driven in accordance with the display timing (fluctuation of light transmissivity of a liquid crystal layer corresponding to pixels) is shown in FIG. 7.

First of all, the summary of the display device 100 according to this embodiment is explained in conjunction with FIG. 3. The display device 100 includes a liquid crystal display panel (hereinafter referred to as "liquid crystal panel") which has resolution of WXGA class as the pixels array. The pixels array 101 having the resolution of WXGA class is not limited to the liquid crystal panel and is characterized in that the pixel rows each of which arranges pixels of 1280 dots in the horizontal direction are arranged in parallel by 768 lines in the vertical direction within a screen. The pixels array 101 of the display device according to this embodiment substantially has the same constitution as the constitution which has been explained in conjunction with FIG. 9. However, because of the resolution, 768 gate lines 10 and 1280 data lines 12 are respectively arranged in parallel in plane within the pixels array 101. Further, in the pixels array 101, 983040 pieces of pixels PIX each of which is selected by the scanning signal transmitted from any one of the former and receives the display signal from any one of the latter are arranged two dimensionally and images are generated by these pixels. When the pixels array display a color image, each pixel is divided in the horizontal direction corresponding to the number of primary colors used in color display. For example, in the liquid crystal panel having color filters corresponding to three primary colors of light (red, green, blue), the number of the above-mentioned data line 12 is increased to 3840 lines and the total number of the pixels PIX contained in the display screen is elevated to a value which is three times as large as the above-mentioned value.

To explain in further detail the above-mentioned liquid crystal panel used as the pixels array 101 in this embodiment, each pixel PIX included in the pixels array 101 is provided with a thin film transistor (abbreviated as TFT) as a switching element SW. Further, each pixel is operated in a so-called normally black-displaying mode which exhibits higher brightness corresponding to the increase of the display signal supplied to the pixel. Not only the pixel of the liquid crystal panel of this embodiment but also the pixel of the above-mentioned electroluminescence array or the pixel of the light emitting diode array is also operated in the normally black-displaying mode. In the liquid crystal panel which is operated in the normally black-displaying mode, corresponding to the increase of the potential difference between a gray scale voltage applied to the pixel electrode PX mounted in the pixel PIX in FIG. 9 from the data line 12 through the switching element SW and a counter voltage (also referred to as reference voltage or common voltage) which is applied to a counter electrode CT which faces the pixel electrode PX in an opposed manner while sandwiching a liquid crystal layer LC therebetween, the light transmissivity of the liquid crystal layer LC is increased so that the brightness of the pixel PIX is increased. In other words, with respect to the gray scale voltage which constitutes the display signal of the liquid crystal panel, the remoter the value of the gray scale voltage from the value of the counter voltage, the display signal is increased.

To the pixels array (TFT type liquid crystal panel) 101 shown in FIG. 3, in the same manner as the pixels array 101 shown in FIG. 9, a data driver (display signal driving circuit) 102 which gives the display signals (gray scale voltage or tone voltage) corresponding to the display data to data lines (signal lines) 12 mounted on the pixels array 101 and scanning drivers (scanning signal driving circuits) 103-1, 103-2, 103-3 which give scanning signals (voltage signals) to gate lines (scanning lines) 10 mounted on the pixels array 101 are respectively provided. In this embodiment, although the scanning driver is divided into three sections along a so-called vertical direction of the pixels array 101, the number of division is not limited to the above and may be replaced with one scanning driver which integrates these functions.

The display control circuit (timing controller) 104 transfers the above-mentioned display data (driver data) 106 and timing signals (data driver control signals) 107 which controls display signal outputs corresponding to the display data 106 to the data driver 102 and transfers scanning clock signals 112 and scanning start signals 113 to the scanning drivers 103-1, 103-2, 103-3 respectively. Although the display control circuit 104 also transfers scan-condition selecting signals 114-1, 114-2, 114-3 corresponding to the scanning drivers 103-1, 103-2, 103-3 to the scanning drivers 103-1, 103-2, 103-3, this function will be explained later. The scan-condition selecting signals are also referred to as display-operation selecting signals in view of the function thereof.

The display control circuit 104 receives video data (video signals) 120 and video control signals 121 from a video signal source arranged outside the display device 100 such as a television receiver set, a personal computer, a DVD player or the like as inputs thereof. Although a memory circuit which temporarily stores the video data 120 is provided in the inside of or in a periphery of the display control circuit 104, the line memory circuit 105 is incorporated in the display control circuit 104 in this embodiment. The video control signals 121 include vertical synchronizing signals VSYNC, horizontal synchronizing signals HSYNC, dot clock signals DOTCLK and display timing signals DTMG which control the transfer state of the video data. The video data which makes the display device 100 generate the image of one screen is inputted to the display control circuit 104 in response to (in synchronism with) the vertical synchronizing signals VSYNC. In other words, the video data is sequentially inputted to the display device 100 (display control circuit 104) from the above-mentioned video signal source every period defined by the vertical synchronizing signal VSYNC (also referred to as vertical scanning period or frame period) and the image of one screen is displayed on the pixels array 101 one after another every frame period. The video data in one frame period divides a plurality of line data included therein in accordance with the period defined by the above-mentioned horizontal synchronizing signals HSYNC (also referred to as a horizontal scanning period) and these line data are sequentially inputted to the display device. In other words, each video data which is inputted to the display device every frame period includes a plurality of line data and the image of one screen which is generated by these line data is generated such that images in the horizontal direction based on respective line data are sequentially arranged in the vertical direction every horizontal scanning period. The data which correspond to respective pixels arranged in the horizontal direction in one screen are discriminated by periods which define respective line data with the above-mentioned dot clock signals.

Since the video data 120 and the video control signals 121 are also inputted to a display device using a cathode ray tube, time is necessary for sweeping the electron beams from the scanning completion position to the scanning start position every horizontal scanning period and every frame period. This time constitutes a dead time in the transfer of video information and hence, a region which is called a retracing period which does not contribute to the transfer of the corresponding video information is also provided to the video data 120. In the video data 120, the region which correspond to this retracing period is discriminated from other regions which contribute to the transfer of the video information in response to the above-mentioned display timing signals DTMG.

On the other hand, the active matrix type display device 100 according to this embodiment generates the display signals for one line of video data (the above-mentioned line data) at the data driver 102 and outputs these display signals simultaneously to a plurality of data lines (signal lines) 12 which are arranged in parallel in the pixels array 101 in response to the selection of gate lines 10 by the scanning drivers 103. Accordingly, theoretically, the inputting of the line data to the pixel row is continued from the horizontal scanning period to the next horizontal scanning period without sandwiching the retracing period, and the inputting of video data to the pixels array from the frame period to the next frame period is also continued. Accordingly, in the display device 100 of this embodiment, reading of every video data (line data) for 1 line from the memory circuit (line memory) 105 performed by the display control circuit 104 is performed in accordance with the period generated by shortening the retracing period contained in the above-mentioned horizontal scanning period HST (allocated to the storage of video data for one line to the memory circuit 105). Since this period is reflected on an output interval of display signals to the pixels array 101 which will be explained later, this period is described as the horizontal period of the pixels array operation or simply as the horizontal period HT. The display control circuit 104 generates a horizontal clock CL1 which defines the horizontal period and transfers the horizontal clock CL1 to the data driver 102 as one of the above-mentioned data driver control signals 107. In this embodiment, with respect to the time for storing the video data for one line in the memory circuit 105 (the above-mentioned horizontal scanning period), time for reading out the video data from the memory circuit 105 (the above-mentioned horizontal period) is shortened so as to manage time for inputting a blanking signal to the pixels array 101 for every one frame period.

FIG. 2 is a timing chart showing one example of video data inputting (storage) to the memory circuit 105 and video data outputting (reading-out) from the memory circuit 105 in the display control circuit 104. The video data which is inputted to the display device every frame period defined by the pulse interval of the vertical synchronizing signal VSYNC is sequentially inputted to the memory circuit 105 by the display control circuit 104 in response to (in synchronism with) the horizontal synchronizing signal HSYNC including the respective retracing period BT for each data of a plurality of line data (video data of one line) L1, L2, L3, . . . included in the video data as indicated by waveforms of input data I-DT. The display control circuit 104 sequentially reads out line data L1, L2, L3, . . . stored in the memory circuit 105 as described in waveforms of the output data in accordance with the above-mentioned horizontal clock CL1 or timing signals similar to these horizontal clock CL1. Here, the retracing periods which make the line data L1, L2, L3, . . . outputted from the memory circuit 105 arranged apart from each other along a time axis are shortened than those which respectively make the line data L1, L2, L3 . . . inputted to the memory circuit 105 apart from each other. Accordingly, between the period necessary for inputting line data N times (N being a natural number of 2 or more) to the memory circuit 105 and the period necessary for outputting these line data from the memory circuit 105 (period for outputting line data N times), time which allows outputting of line data from the memory circuit 105 M times (M being a natural number small than N) is generated. In this embodiment, using a so-called an extra time which allows the video data for M lines outputted from the memory circuit 105, it is possible to make the pixels array 101 to perform another or separate display operation.

Here, the video data (line data included in the video data in FIG. 2) are temporarily stored in the memory circuit 105 before they are transferred to the data driver 102. Accordingly, the video data is read out from the display control circuit 104 with a delay time DLT corresponding to the stored period. When the memory circuit 105 is used as a frame memory, this delay time corresponds to one frame period. When the video data is inputted to the display device at a frequency of 30 Hz, this one frame period is approximately 33 ms (milliseconds) and hence, a user of the display device can not perceive the delay of the display time of the image with respect to the input time of the video data to the display device. However, by providing a plurality of line memories to the display device 100 as the above-mentioned memory circuit 105 in place of the frame memory, this delay time can be shortened and the circuit structure of the display control circuit 104 or the periphery of the display control circuit 104 can be simplified, or the increase of the dimensions of the display control circuit 104 or the periphery thereof can be suppressed.

With respect to the memory circuit 105, an example of a driving method of the display device 100 which uses line memories storing a plurality of line data is explained with reference to FIG. 5. In the driving of the display device 100 according to this example, in the above-mentioned extra time which is generated between the video data inputting period for N lines to the display control circuit 104 and the video data outputting period for N lines from the display control circuit 104 (period for sequentially outputting the display signals corresponding to the respective video data of N lines) from the data driver 102, the display signals which mask the display signals which are already stored in the pixels array (video data which is inputted to the pixels array within the one preceding frame period) (hereinafter referred to as "blanking signals") are written M times. In this driving method of the display device 100, a first step in which the display signals are sequentially generated from respective video data of N lines by the data driver 102 and the display signals are sequentially (N times in total) outputted to the pixels array 101 in response to the horizontal clocks CL1 and a second step in which the above-mentioned blanking signals are outputted to the pixels array 101 M times in response to the horizontal clocks CL1 are repeated. Although the further explanation of this driving method of the display device is made later in conjunction with FIG. 1, the value of N is set to 4 and the value of M is set to 1 in FIG. 5.

As shown in FIG. 5, the memory circuit 105 includes four line memories 1 to 4 which can independently perform writing and reading-out of data and the video data 120 for every one line which are sequentially inputted to the display device 100 in synchronism with the horizontal synchronizing signal HSYNC are stored sequentially in one of these line memories 1 to 4. In other words, the memory circuit 105 includes a memory capacity for four lines. For example, in an acquisition period Tin for four lines of video data 120 by the memory circuit 105, four lines of video data W1, W2, W3, W4 are sequentially inputted to the line memory 1 to the line memory 4. This acquisition period Tin of the video data extends over time which is four times as large as the horizontal scanning period defined by the pulse interval of the horizontal synchronizing signals HSYNC contained in the video control signals 121. However, before this acquisition period Tin of the video data is completed due to the storage of the video data to the line memory 4, the video data stored in the line memory 1, the line memory 2 and the line memory 3 are sequentially read out as video data R1, R2, R3 within this period due to the display control circuit 104. Accordingly, as soon as the acquisition time Tin for four lines of video data W1, W2, W3, W4 is completed, the storage of next four lines of video data W5, W6, W7, W8 in the line memories 1 to 4 can be started.

In the above-mentioned explanation, with respect to the reference symbols each of which is given for every one line of the video data, the reference symbols are changed between at the time of inputting video data to the line memories and at the time of outputting the video data from the line memories such that W1 is given to the former and R1 is given to the latter, for example. Here, the video data for every one line includes the above-mentioned retracing period. This reflects on the fact that when the video data is read out in response to (in synchronism with) the horizontal clock CL1 having the frequency which is higher than the above-mentioned horizontal synchronizing signals HSYNC from any one of the line memories 1 to 4, the retracing period included in the video data is compressed. Accordingly, compared to the length along the time axis of the video data W1 (hereinafter referred to as "line data") for one line inputted to the line memory 1, for example, the length along the time axis of the line data R1 outputted from the line memory 1 is short as shown in FIG. 5. During the period from inputting of the line data to the line memory to outputting of the line data from the line memory, the length along the time axis can be compressed as described above even when the video information contained in the line data (for example, generating video of one line in the horizontal direction of the screen) is not processed. Accordingly, there arises the above-mentioned extra time Tex between the time that the outputting of four lines of video data R1, R2, R3, R4 from the line memories 1 to 4 is completed and the time that the outputting of four lines of video data R5, R6, R7, R8 from the line memories 1 to 4 is started.

Four lines of video data R1, R2, R3, R4 read out from the line memories 1 to 4 are transferred to the data driver 102 as the driver data 106 and the display signals L1, L2, L3, L4 corresponding to the respective lines of video data R1, R2, R3, R4 are generated (the display signals L5, L6, L7, L8 being also generated with respect to four lines of video data R5, R6, R7, R8 which will be read out next time). These display signals are respectively outputted to the pixels array 101 in response to the above-mentioned horizontal clock CL1 in the order indicated by an eye diagram of the display signal outputting shown in FIG. 5. Accordingly, by incorporating the line memories (or an integrated body thereof) which have a capacity of the above-mentioned N lines in the memory circuit 105, it is possible to input one line of video data which is inputted to the display device within a certain frame period to the pixels array within the frame period so that the response speed of the display device to the inputting of video data can be enhanced. FIG. 2 shows an output display signal O-DDR from the data driver.

On the other hand, as can be understood from FIG. 5, the above-mentioned extra time Tex corresponds to time for outputting one line video data from the line memory in response to the above-mentioned horizontal clock CL1. In this embodiment, another display signal is outputted to the pixels array one time by making use of this extra time Tex. Another display signal in this embodiment is a so-called blanking signal B which reduces the brightness of the pixel to which another display signal is supplied below the brightness of the pixel before the another display signal is supplied to the pixel. For example, the brightness of the pixel displayed with a relatively high gray scale (white or light gray similar to white in a monochroic image display) in one preceding frame is reduced below the previous brightness due to this blanking signal B. On the other hand, the brightness of the pixel displayed with a relatively low gray scale (black or dark gray such as charcoal gray similar to black in a monochroic image display) in the preceding one frame is hardly changed even after the blanking signal B is inputted. With this blanking signal B, the image generated on the pixels array every frame period is temporarily converted into dark image (blanking image). Due to such a display operation of the pixels array, even in the hold-type display device, the image display in response to the video data inputted to the display device every frame period can be performed in the same manner as the impulse-type display device.

By applying the driving method of the display device which repeats the first step which sequentially outputs the previously-mentioned N line of video data to the pixels array and the second step which outputs the blanking signal B to the pixels array M times to the hold-type display device, the image display performed by this hold-type display device can be performed in the same manner as the impulse-type display device. This driving method of the display device is applicable not only to the display device explained in conjunction with FIG. 5 which includes the line memories having the capacity of at least N lines but also to a display device which replaces the memory circuit 105 with frame memories, for example.

Such driving method of the display device is further explained in conjunction with FIG. 1. While the operation of the display device in the above-mentioned first and second steps define the outputting of display signals by the data driver 102 of the display device 100 shown in FIG. 3, the outputting of scanning signals (selecting of pixel row) by the scanning driver 103 in response to the outputting of display signals is described as follows. In the explanation described hereinafter, "scanning signals" which are applied to the gate lines (scanning signal lines) 10 and select the pixel rows (a plurality of pixels PIX arranged in parallel along the gate lines) corresponding to the gate lines indicate pulses (gate pulses) of the scanning signals in which the scanning signals which are respectively applied to the gate lines G1, G2, G3, . . . shown in FIG. 1 assume the High state. In the pixels array shown in FIG. 9, the switching elements SW which are provided to the pixels PIX, upon receiving the gate pulses through the gate lines 10 which are connected to the pixels PIX, allow the display signals supplied from the data lines 12 to be inputted to the pixels PIX.

In the period which corresponds to the above-mentioned first step, every time the display signal corresponding to the N-line video data is outputted, the scanning signal which selects the pixel rows corresponding to Y gate lines is applied to the Y gate lines. Accordingly, the scanning signals are outputted from the scanning drivers 103 N times. Each time the display signal is outputted, such applying of the scanning signals is performed sequentially from one end of the pixels array 101 (for example, upper end in FIG. 3) to the other end of the pixels array 101 (for example, lower end in FIG. 3) every other Y gate lines. Accordingly, in the first step, the pixel rows which correspond to (Y×N) gate lines are selected and the display signals which are generated by the video data are supplied to respective pixel rows. FIG. 1 shows outputting timing of display signals (see eye diagram of the data driver output voltages) when the value of N is set to 4 and the value of Y is set to 1 and waveforms of the scanning signals which are respectively supplied to the gate lines (scanning lines) corresponding to the outputting timing. In the period of the first step, the scanning signals correspond to respective data driver output voltages 1 to 4, 5 to 8, 9 to 12, . . . , 513 to 516. In response to the data driver output voltages 1 to 4, the scanning signals are sequentially applied to the gate lines G1 to G4. In response to the next data driver output voltages 5 to 8, the scanning signals are sequentially applied to the gate lines G5 to G8. After the further lapse of time, in response to the data driver output voltages 513 to 516, the scanning signals are sequentially applied to the gate lines G513 to G516. That is, from the scanning driver 103, the scanning signal outputting is sequentially performed in the direction along which the address number of the gate line 10 in the pixels array 101 is increased (G1, G2, G3, . . . , G257, G258, G259, . . . , G513, G514, G515, . . . ), On the other hand, in the period corresponding to the above-mentioned second step, each time the display signals are outputted as blanking signals M times, the scanning signal which selects the pixel row corresponding to the outputting is applied to the Z line of the gate lines. Accordingly, the scanning signals are outputted from the scanning driver 103 M times. With respect to outputting of the scanning signal one time from the scanning drivers 103, although the combination of the gate lines (scanning lines) to which the scanning signals are applied is not particularly limited, it is preferable to sequentially apply the scanning signal to the gate line at every other Z line each time the display signal is outputted in view of holding the display signal supplied to the pixel row in the first step and reducing a load applied to the data driver 102. The applying of the scanning signals to the gate line in the second step is sequentially performed in the order from one end to the other end of the pixels array 101 in the same manner as the first step. Accordingly, in the second step, the pixel rows which correspond to the (Z×M) lines of gate lines are selected and the blanking signals are supplied to respective pixel rows. FIG. 1 shows outputting timing of blanking signals B in the respective second steps which follow the respective first steps when the value of M is set to 1 and the value of Z is set to 4 and waveforms of the scanning signals which are respectively supplied to the gate lines (scanning lines) corresponding to the outputting timing. In the second step which follows first step in which the scanning signals are sequentially applied to the gate lines G1 to G4, in response to the outputting of one blanking signal B, the scanning signals are applied to the four gate lines ranging from G257 to G260. In the second step which follows first step in which the scanning signals are sequentially applied to the gate lines G5 to G8, in response to the outputting of one blanking signal B, the scanning signals are applied to the four gate lines ranging from G261 to G264. Further, in the second step which follows first step in which the scanning signals are sequentially applied to the gate lines G513 to G516, in response to the outputting of one blanking signal B, the scanning signals are applied to the four gate lines ranging from G1 to G4.

As described above, the scanning signals are sequentially applied to four respective gate lines in the first step and the scanning signals are applied to four gate lines simultaneously in the second step. Accordingly, it is necessary to make the operation of the scanning drivers 103 match respective steps in response to the outputting of display signals from the data driver 102, for example. As mentioned previously, the pixels array used in this embodiment has the resolution of WXGA class and 768 gate lines are arranged in parallel in the pixels array. On the other hand, a group of four gate lines (G1 to G4, for example) sequentially selected in the first step and a group of four gate lines (G257 to G260, for example) sequentially selected in the second step which follows the first step are arranged apart from each other by way of 252 gate lines along the direction in which the address numbers of gate lines 10 in the pixels array 101 is increased. Accordingly, 768 gate lines arranged in parallel in the pixels array are divided into three groups along the vertical direction (or the data line extending direction) wherein each group includes 256 lines and the outputting operation of the scanning signals from the scanning drivers 103 is independently controlled with respect to each group. Accordingly, in the display device shown in FIG. 3, three scanning drivers 103-1, 103-2, 103-3 are arranged along the pixels array 101 and the outputting operation of the scanning signals from respective scanning drivers 103-1, 103-2, 103-3 is controlled in response to the scan-condition selecting signals 114-1, 114-2, 114-3. For example, when the gate lines G1 to G4 are selected in the first step and the gate lines G257 to G260 are selected in the second step which follows the first step, the scan-condition selecting signal 114-1 instructs the scanning driver 103-1 to take the scanning state in which the outputting of scanning signal for sequentially selecting the gate lines for four continuous pulses of scanning clock signals CL3 line by line and the stop of outputting of scanning signals for one pulse of the scanning clock CL3 which follows the preceding outputting are repeated. On the other hand, the scan-condition selecting signal 114-2 instructs the scanning driver 103-2 to take the scanning state in which the stop of outputting of scanning signal to continuous four pulses of the scanning clocks CL3 and the outputting of scanning signals to four gate lines for one pulse of the scanning clock CL3 which follows the preceding stop of outputting are repeated. Further, the scan-condition selecting signal 114-3 makes the scanning clock CL3 which is inputted to the scanning driver 103-3 ineffective and stops the outputting of the scanning signals in response to the scanning clock CL3. Each one of the scanning drivers 103-1, 103-2, 103-3 is provided with two control signal transmission networks corresponding to the above-mentioned two instructions derived from the scan-condition selecting signals 114-1, 114-2 and 114-3.

On the other hand, the waveforms of the scanning start signals FLM shown in FIG. 1 include two pulses which respectively rise at a time t1 and a time t2. A series of gate line selection operations in the above-mentioned first step are respectively started in response to pulses of the scanning start signals FLM generated at the time t1 (referred also to pulse 1 and referred to as first pulse hereinafter), while a series of gate line selection operations in the above-mentioned second step are respectively started in response to pulses of the scanning start signals FLM generated at the time t2 (referred also to pulse 2 and referred to as second pulse hereinafter). The first pulse of the scanning start signal FLM also corresponds to the start of inputting of video data during one frame period to the display device (defined by pulses of the above-mentioned vertical synchronizing signals VSYNC). Accordingly, the first pulse and the second pulse of the scanning start signal FLM are repeatedly generated every frame period. Further, by adjusting an interval between the first pulse and the succeeding second pulse of the scanning start signal FLM and an interval between the second pulse and a pulse succeeding the second pulse (the first pulse of next frame period, for example), it is possible to adjust time for holding display signals in response to the video data in the pixels array during one frame period. In other words, the pulse intervals including the first pulse and second pulse generated at the scanning start signals FLM are capable of taking two difference values (time widths) alternately. On the other hand, the scanning start signals FLM are generated by the display control circuit (timing controller) 104. In view of the above, the above-mentioned scan-condition selecting signals 114-1, 114-2, 114-3 can be generated in conjunction with the scanning start signals FLM in the display control circuit 104.

The operation to write the blanking signal in the pixels array one time each time the video data shown in FIG. 1 is written in the pixels array four times for each line is completed within time in which four lines of video data are inputted to the display device as explained in conjunction with FIG. 5. Further, in response to this operation, the scanning signal is outputted to the pixels array five times. Accordingly, the horizontal period necessary for the operation of the pixels array assumes 4/5 of the horizontal scanning period of the video control signal 121. In this manner, the inputting of the video data (display signals based on the video data) inputted to the display device and the blanking signal into all pixels in the inside of the pixels array within one frame period is completed within one frame period.

The blanking signals shown in FIG. 1 generate pseudo video data (hereinafter referred to as "blanking data") in the display control circuit 104 and a peripheral circuit thereof. The blanking data may be generated in the data driver 102 by transferring the blanking data to the data driver 102 or a circuit which generates the blanking signals is preliminarily provided in the data driver 102 and the blanking signals may be outputted to the pixels array 101 in response to specified pulses of the horizontal clocks CL1 transferred from the display control circuit 104. In the former case, a frame memory is provided in the display control circuit 104 or in a periphery thereof, and based on the video data of every frame period which is stored in the frame memory, the pixels which should strengthen the blanking signals (pixels which are displayed with high brightness in response to the video data) are specified by the display control circuit 104, and the blanking data which makes the data driver 102 generate blanking signals which differ in darkness in response to pixels may be generated. In the latter case, the number of pulses of the horizontal clock CL1 is counted by the data driver 102 and the display signal which make the pixels display black or dark color similar to black (color such as charcoal gray, for example) in response to the counted number are outputted. A part of the liquid crystal display device generates a plurality of gray scale voltages which determine the brightness of pixels at the display control circuit (timing converter) 104. In such a liquid crystal display device, a plurality of gray scale voltages are transferred to the data driver 102 and the data driver 102 selects the gray scale voltages which correspond to the video data and outputs the selected gray scale voltages to the pixels array. However, in the same manner, the blanking signals may be generated by selecting the gray scale voltages in response to pulses of the horizontal clocks CL1 by the data driver 102.

The outputting manner of display signals to the pixels array and the outputting manner of scanning signals to respective gate lines (scanning lines) in response to the outputting of the display signals in the present invention shown in FIG. 1 are suitable for driving the display device which is provided with the scanning drivers 103 having a function of simultaneously outputting the scanning signals to a plurality of gate lines in response to the inputted scan-condition selecting signals 114. On the other hand, it is also possible to perform the image display operation according to this embodiment in such a manner that without making respective scanning drivers 103-1, 103-2, 103-3 simultaneously output the scanning signals to a plurality of scanning lines as mentioned above, the scanning signals are sequentially outputted for each one gate line (scanning line)

each time the pulse of the scanning clock CL3 is inputted. Due to the operation of the scanning drivers 103, this embodiment performs the image display operation in which each time four lines of video data are sequentially inputted to one of pixel rows line by line (the above-mentioned first step in which the video data are outputted four times), blanking data is inputted to four lines of another pixel row (the above-mentioned first step in which the blanking data is outputted one time) and such an operation is repeated. The image display operation of this embodiment is explained in conjunction with respective waveforms of the display signals and the scanning signals shown in FIG. 4.

In the driving method of the display device which is explained in conjunction with FIG. 4, the display device shown in FIG. 1 and FIG. 3 is referred to. Each scanning driver 103-1, 103-2, 103-3 includes 256 terminals for outputting the scanning signals. In other words, each scanning driver 103 can output the scanning signals to 256 gate lines at maximum. On the other hand, 768 gate lines 10 and the pixel rows which respectively correspond to the gate lines 10 are provided to the pixels array 101 (liquid crystal display panel, for example). Accordingly, three scanning drivers 103-1, 103-2, 103-3 are sequentially arranged at one side along the vertical direction of the pixels array 101 (extending direction of the data lines 12 provided to the pixels array 101). The scanning driver 103-1 outputs the scanning signals to a group of gate lines G1 to G256, the scanning driver 103-2 outputs the scanning signals to a group of gate lines G257 to G512, and the scanning driver 103-3 outputs the scanning signals to a group of gate lines G513 to G768 and these scanning drivers 103-1, 103-2, 103-3 control the image display of the whole screen (all regions of pixels array 101) of the display device 100. The display device to which the driving method which has been explained in conjunction with FIG. 1 and the display device to which a driving method which will be explained hereinafter in conjunction with FIG. 4 are in common with respect to a point that they have the above-mentioned arrangement of scanning drivers. Further, the driving method of the display device which has been explained in conjunction with FIG. 1 and the driving method of the display device which will be explained hereinafter in conjunction with FIG. 4 are in common with respect to a point that the scanning start signal FLM includes the first pulse which starts outputting of a series of scanning signals which are served for inputting the video data to the pixels array and the second pulse which starts outputting of a series of scanning signals which are served for inputting the blanking data to the pixels array in each frame period. Still further, the driving method of the display device which uses the signal waveforms shown in FIG. 1 and the driving method of the display device which uses the signal waveforms shown in FIG. 4 are in common with respect to a point that the scanning drivers 103 acquires the above-mentioned respective first pulse and second pulse of the scanning start signal FLM in response to the scanning clock CL3 and, thereafter, sequentially shifts terminals (or a group of terminals) to which the scanning signals are to be outputted in response to the scanning clock CL3 in response to acquisition of the video data or the blanking data into the pixels array.

However, the driving method of the display device according to this embodiment which has been explained in conjunction with FIG. 4 differs from the driving method of the display device explained in conjunction with FIG. 1 with respect to roles of the scan-condition selecting signals 114-1, 114-2, 114-3. In FIG. 4, the respective waveforms of the scan-condition selecting signals 114-1, 114-2, 114-3 are indicated by DISP1, DISP2, DISP3. First of all, the scan-condition selecting signals 114, in response to operation conditions which are applied to regions which the respective scan-condition selecting signals 114 control (a group of pixels corresponding to the group of gate lines G257 to G512 in case of DISP2, for example), determines the outputting operation of the scanning signal in the region. In FIG. 4, during the period in which the data driver output voltages indicate outputs of the display signals L513 to L516 corresponding to the four lines of video data (the above-mentioned first step in which the display signals L513 to L516 are outputted), the scanning signals are applied to the gate lines G513 to G516 which correspond to the pixel row into which the display signals are inputted from the scanning driver 103-3. Accordingly, the scan-condition selecting signals 114-3 which are transferred to the scanning driver 103-3 performs the so-called gate line selection of every line which sequentially outputs the scanning signal for every line of the gate lines G513 to G516 in response to the scanning clocks CL3 (every outputting of one gate pulse). Accordingly, the display signal L513 is supplied to the pixel row corresponding to the gate line G513, then, the display signal L514 is supplied to the pixel row corresponding to the gate line G514 and, further, the display signal L515 is supplied to the pixel row corresponding to the gate line G515, and finally the display signal L516 is supplied to the pixel row corresponding to the gate line G516 over respective one horizontal periods (defined by pulse intervals of the horizontal clocks CL1).

On the other hand, in the above-mentioned second step which follows the first step in which the display signals L513 to L516 are sequentially outputted every horizontal period (in response to pulses of the horizontal clock CL1), the blanking signal B is outputted in one horizontal period which succeeds the four horizontal periods corresponding to the first step. In this embodiment, the blanking signal B which is outputted between the display signal L516 and the display signal L517 is supplied to respective pixel rows which correspond to the group of gate lines G5 to G8. Accordingly, the scanning driver 103-1 must perform the so-called four-gate-line simultaneous selection which applies the scanning signal to all four gate lines G5 to G8 during the outputting period of the blanking signal B. However, in the display operation of the pixels array according to FIG. 4, as mentioned above, although the scanning driver 103 starts the applying of the scanning signal only to one gate line in response to the scanning clock CL3 (with respect to one pulse thereof), the scanning driver 103 does not start the applying of the scanning signal to a plurality of gate lines. In other words, the scanning drivers 103 do not simultaneously rise the scanning signal pulses for a plurality of gate lines.

Accordingly, the scan-condition selecting signal 114-1 which is transferred to the scanning driver 103-1 controls the scanning driver 103-1 such that the scanning signal is applied to at least (Z−1) lines of Z gate lines to which the scanning signal is to be applied before outputting the blanking signal B and the time for applying scanning signal (pulse width of the scanning signal) is prolonged at least N times compared to the horizontal period. With respect to these variables Z, N, Z is the number of selection of gate lines in the second step which has been explained in conjunction with the first step for writing the above-mentioned video data into the pixels array and the second step in which the blanking data is written in the pixels array and N is the number of outputting of the display signals in the first step.

For example, over a period five times larger than the horizontal period, the scanning signal is applied to the gate line G5 from the outputting start time of the display signal L514, the scanning signal is applied to the gate line G6 from the outputting start time of the display signal L515, the scanning signal is applied to the gate line G7 from the outputting start time of the display signal L516, and the scanning signal is applied to the gate line G8 from the outputting completion time of the display signal L516 (outputting start time of the succeeding blanking signal B). In other words, although respective rise time of the gate pulses of the group of gate lines G5 to G8 set by the scanning driver 103 are sequentially shifted every one horizontal period in response to the scanning clock CL3, by delaying the fall time of the respective gate pulses after the N horizontal period from the rise time, it is possible to obtain the state in which all gate pulses of the group of gate lines G5 to G8 rise in the above-mentioned blanking signal outputting period (High in FIG. 4). In controlling the outputting of the gate pulses, it is preferable to make the scanning drivers 103 include the shift register operation function. Here, hatched areas indicated in the gate pulses of the gate lines G1 to G12 which supply the blanking signals to the corresponding pixel rows will be explained later.

To the contrary, the display signals are not supplied to the pixel rows which respectively correspond to a group of gate lines G257 to G512 which receive the scanning signals from the scanning driver 103-2 during this period (the above-mentioned first step in which the display signals L513 to L516 are outputted) and the second step which succeeds the first step. Accordingly, the scan-condition selecting signal 114-2 which is transferred to the scanning driver 103-2 makes the scanning clock CL3 ineffective for the scanning driver 103-2 during a period extending over the first step and the second step. The operation to make the scanning clock CL3 ineffective based on the scan-condition selecting signal 114 is applicable at a given timing even when the display signal or the blanking signal is supplied to a group of pixels in a region into which the scanning signals are outputted from the scanning drivers 103 to which the scanning clock signal CL3 is transferred. FIG. 4 shows waveforms of the scanning clock CL3 which correspond to the outputting of scanning signals at the scanning driver 103-1. Although the pulses of the scanning clock CL3 correspond to the pulses of the horizontal clock CL1 which defines an interval of outputting the display signals and the blanking signals, the pulses are not generated at the outputting start times of the display signals L513, L517, . . . . In this manner, the operation to make the scanning clock signal CL3 transferred to the scanning drivers 103 from the display control circuit 204 at specific times can be performed in response to the scan-condition selecting signal 114. The operation to partially make the scanning clock CL3 ineffective with respect to the scanning drivers 103 can be performed by incorporating a signal processing path which corresponds to the scanning clock CL3 into the scanning driver 103 and starting the operation of the signal processing path in response to the scan-condition selecting signal 114 transferred to the scanning drivers 103. Although not shown in FIG. 4, the scanning drivers 103-3 which controls the writing of the video data in the pixels array becomes insensitive to the scanning clock CL3 at the outputting start time of the blanking signals B. Accordingly, in the first step which follows the second step which is performed based on the outputting of the blanking signals B, it is possible to prevent the scanning driver 103-3 from erroneously supplying the blanking signals to the pixel rows to which the display signals are supplied in response to the video data.

Subsequently, the scan-condition selecting signals 114 make the pulses of scanning signals (gate pulses) which are sequentially generated in the regions which the scan-condition selecting signals 114 respectively control ineffective at a stage in which the gate pulses are outputted to the gate lines. This function makes, in the driving method of the display device shown in FIG. 4, the scan-condition selecting signals 114 which are transferred to the scanning drivers 103 contribute to the signal processing in the inside of the scanning drivers 103 for supplying the blanking signals to the pixels array. Three waveforms DISP1, DISP2, DISP3 shown in FIG. 4 indicate the scan-condition selecting signals 114-1, 114-2, 114-3 which contribute to the signal processing in the inside of the respective scanning drivers 103-1, 103-2, 103-3 and the outputs of the gate pulses are assumed to be effective when the scan-condition selecting signals 114-1, 114-2, 114-3 are at the Low-level. Further, the waveform DISP1 of the scan-condition selecting signal 114-1 assumes the High-level during the period in which the display signals are outputted to the pixels array in accordance with the above-mentioned first step and makes the outputting of the gate pulses generated by the scanning driver 103-1 during this period ineffective.

For example, the gate pulses generated on the scanning signals which respectively correspond to the gate lines G1 to G7 in four horizontal periods in which the display signals L513 to L516 are supplied to the pixels array have respective outputs thereof made ineffective as indicated by hatching due to the scan-condition selecting signal DISP1 which assumes the High level during this period. Accordingly, it is possible to prevent the display signals based on video data from being erroneously supplied to the pixel rows to which the blanking signals are to be supplied during a certain period so that the blanking display at these pixel rows (erasure of video displayed on these pixel rows) can be surely performed and, further, the loss of the intensity of the display signals per se derived from the video data can be prevented. Further, during one horizontal period in which the blanking signals B are outputted between four horizontal periods in which the display signals L513 to L516 are outputted and next four horizontal periods in which the display signals L517 to L520 are outputted, the scan-condition selecting signal DISP1 assumes the Low-level. Accordingly, the gate pulses which are generated in the scanning signals which respectively correspond to the gate lines G5 to G8 during this period are simultaneously outputted to the pixels array and simultaneously select the pixel rows corresponding to these four gate lines and supply the blanking signals B to the respective pixel rows.

As described above, in the display operation of the display device according to FIG. 4, in response to the scan-condition selecting signals 114, it is possible to determine not only the operation state of the scanning drivers 103 to which these scan-condition selecting signals 114 are transferred (the operation state which depends on either one of the above-mentioned first step or second step or non-operation state which depends on neither of them) but also the effectiveness of the outputting of gate pulses which are generated by the scanning drivers 103 in response to the operation states. Here, a series of controls of the scanning drivers 103 (outputting of scanning signals from the scanning drivers 103) in response to these scan-condition selecting signals 114 are started from outputting of the scanning signal to the gate line G1 in response to the scanning start signal FLM with respect to both of writing of the display signals based on video data and writing of the blanking signals to the pixels array. FIG. 4 mainly shows the gate line selection operation (four-line simultaneous selection operation) by the scanning drivers 103 which are sequentially shifted based on the scan-condition selecting signal DISP1 in response to the above-mentioned second pulse of the scanning start signal FLM. Although not shown in FIG. 4, with respect to the operation of the display device shown in FIG. 4, every one gate-line selection operation by the scanning drivers 103 is also sequentially shifted in response to the first pulse of the scanning start signal FLM. Accordingly, also in the operation of the display device shown in FIG. 4, it is necessary to start scanning of two kinds of pixels arrays one time for each in response to the scanning start signal FLM every frame period, wherein the first pulse and the second pulse which follows the first pulse appear on the waveforms of the scanning start signal FLM.

In both of the driving methods of display device which are explained in conjunction with FIG. 1 and FIG. 4, the number of scanning drivers 103 which are arranged along one side of the pixels array 101 and the number of scan-condition selecting signals 114 transmitted to these scanning drivers 103 are changeable without changing the structure of the pixels array 101 which has been explained in conjunction with FIG. 3 and FIG. 9 and the respective functions which are shared by three scanning drivers 103 may be integrated into one scanning driver 103 (For example, the inside of the scanning driver 103 may be divided into circuit sections corresponding to the above-mentioned three scanning drivers 103-1, 103-2, 103-3).

FIG. 6 is a timing chart showing the image display timing according to the display device of this embodiment over three continuous frame periods. At the beginning of each frame period, only the writing of video data PXD from the first scanning line (corresponding to the above-mentioned gate line G1) to the pixels array is started in response to the first pulse of the scanning start signal FLM and, after a lapse of time Δt1 from this point of time, the writing of the blanking data BLD (for example, black display data) is started from the first scanning line to the pixels array in response to the second pulse of the scanning start signal FLM. Further, after a lapse of time Δt2 from a point of time that the second pulse of the scanning start signal FLM is generated, the writing of the video data to be inputted to the display device to the pixels array in the next frame period is started in response to the first pulse of the scanning start signal FLM. In this embodiment, time Δt1' shown in FIG. 6 is equal to time Δt1 and time Δt2' shown in FIG. 6 is equal to time Δt2. Although the progress of writing of video data into the pixels array and the progress of writing of blanking data into the pixels array differ in the number of gate lines which both writings select during one horizontal period (one line at the former and four lines at the latter), they are substantially equal with respect to the lapse of time. Accordingly, irrespective of the positions of the scanning lines in the pixels array, the period in which the pixel rows which correspond to the scanning lines hold the display signals based on the video data (substantially extended to the above-mentioned time Δt1 including time for receiving the display signals) and the period in which the pixel rows hold the blanking signals ((substantially extended to the above-mentioned time Δt2 including time for receiving the blanking signals) extend in the vertical direction of the pixels array and become approximately uniform. In other words, the irregularities of the display brightness between the pixel rows (along the vertical direction) in the pixels array can be suppressed. In this embodiment, as shown in FIG. 6, 67% and 33% of one frame period are allocated to the display period of video data and the display period of blanking data in the pixels array and the timing of the scanning start signal FLM is adjusted (the above-mentioned times Δt1 and Δt2 being adjusted) in accordance with such an allocation. However, the display period of video data and the display period of blanking data can be suitably changed by changing the timing of the scanning start signal FLM.

An example of the brightness response of the pixel row when the display device is operated at the image display timing based on FIG. 6 is shown in FIG. 7. This brightness response uses a liquid crystal display panel which has resolution of WXGA class and is operated in the normally black display mode as the pixels array 101 FIG. 3, wherein the display ON data which displays the pixel rows in white is written as the video data and the display OFF data which displays the pixel rows in black is displayed as the blanking data. Accordingly, the brightness response, that is, display brightness B taken on the axis of ordinates shown in FIG. 7 indicates the fluctuation of light transmissivity of the liquid crystal layer corresponding to the pixel row of the liquid crystal display panel. As shown in FIG. 7, in one frame period, the pixel row (respective pixels included in the pixel row) responds to the brightness corresponding to the video data PXD and, thereafter, responds to the black brightness corresponding to the blanking data BLD. Although the light transmissivity of the liquid crystal layer relatively gently responds to the fluctuation of an electric field applied to the liquid crystal layer, as can be clearly understood from FIG. 7, the value sufficiently responds to both of an electric field corresponding to the video data and an electric field corresponding to the blanking data for every frame period. Accordingly, images based on image data generated on a screen (pixel rows) during the frame period are sufficiently erased from the screen (pixel rows) within the frame period and hence, the images are displayed in the same manner as the impulse-type display device. Due to such an impulse-type response of the images due to video data, a blurring phenomenon on moving images generated on the screen can be reduced. Such an advantageous effect can be obtained in the same manner either by changing the resolution of the pixel array or by changing the ratio of retracing period in the horizontal period of the driver data shown in FIG. 2.

In the above-mentioned embodiment, in the first step, the display signals which are generated every one line of video data are sequentially outputted to the pixels array four times and are sequentially supplied respectively to the pixel row corresponding to one gate line, and in the second step which follows the first step, the blanking signals are sequentially outputted to the pixels array one time and are supplied to the pixel row corresponding to four gate lines. However, the number N of outputting of display signals in the first step (this value also corresponding to the number of line data written in the pixels array) is not limited to 4 and the number M of outputting of blanking signals in the second step is not limited to 1. Further, the number Y of gate lines to which the scanning signals (selection signals) are applied in response to one outputting of display signals in the first step is not limited to 1 and the number Z of the gate lines to which the scanning signals are applied in response to one outputting of blanking signals in the second step is not limited to 4. These factors N, M are requested to be natural numbers which satisfy a condition $M<N$ and to satisfy another condition that N is 2 or more. Further, it is also requested that the factor Y is the natural number smaller than N/M and the factor Z is the natural number equal to or larger than N/M. Still further, it is requested to complete one cycle consisting of outputting of display signals N times and outputting of blanking signals M times within the period in which N lines of video data are inputted into the display device. In other words, the value which is (N+M) times as large as the horizontal period in the operation of the pixels array is set equal to or below a value which is N time as large as the horizontal scanning period in the inputting of the video data into the display device. The former horizontal period is defined by an interval of pulses of the horizontal clock CL1 and the latter horizontal scanning period is defined by an interval of pulses of the horizontal synchronizing signals HSYNC which constitutes one of the video control signals.

According to such operation conditions of the pixels array, during the period Tin in which N lines of video data are inputted to the display device, the signals are outputted from the data driver 102 (N+M) times. That is, one cycle of the operation of the pixels array consisting of the above-mentioned first step and second step which follows the first step is performed. Accordingly, the time allocated respectively to outputting of the display signals and outputting of blanking signals in this one cycle (hereinafter referred to as "Tinvention") is reduced to (N/(N+M)) times of the time necessary for outputting the display signal one time when the display signals corresponding to the N lines of video data are sequentially outputted (hereinafter referred to as "Tprior"). However, since the factor M is the natural number smaller than N as described above, the time Tinvention for outputting respective signals in the above-mentioned one cycle according to the present invention can ensure the length of time equal to or more than ½ of the above-mentioned Tprior. That is, in view of writing of the video data to the pixels array, the advantage of the previously-mentioned SID 01 Digest, pages 994–997 over the technique described in the previously-mentioned Japanese Laid-open Patent Publication 166280/2001 can be obtained.

Further, according to the present invention, by supplying the blanking signals to the pixels within the above-mentioned period Tinvention, the brightness of the pixels can be quickly reduced. Accordingly, compared to the technique described in the SID 01 Digest, pages 994–997, according to the present invention, the video display period of respective pixel rows and the blanking display period in one frame can be clearly divided so that a blurring phenomenon of moving images can be efficiently reduced. Further, although the blanking signals are intermittently supplied to the pixels every (N+M) times, it is possible to suppress the irregularities of ratio between the video display period and the blanking display period which is caused between the pixel rows by supplying the blanking signal to the pixel rows corresponding to Z gate lines with respect to outputting of the blanking signals one time. Further, by sequentially applying the scanning signals to every other Z gate lines with respect to every outputting of the blanking signals, a load which is necessary with respect to outputting of the blanking signals from the data driver 102 one time can be reduced by limiting the number of pixel rows to which the blanking signals are supplied.

Accordingly, the driving of the display device according to the present invention is not limited to the example in which N, M, Y and Z which have been explained in conjunction with FIG. 1 to FIG. 7 are set to 4, 1, 1 and 4 respectively. That is, so long as the above-mentioned conditions are satisfied, the driving of the display device according to the present invention is universally applicable to the general driving of the hold-type display device. For example, when either one of odd-numbered line and the even-numbered line of video data is inputted to the display device every frame period using an interlace method, the odd-numbered line or the even-numbered line of video data is sequentially applied every one line and the scanning lines are applied every two other gate lines, and the display signals are supplied to the pixel rows corresponding to these lines (In this case, at least the above-mentioned factor Y assumes 2). Further, in the driving of the display device according to the present invention, the frequency of the horizontal clock CL1 is set to be ((N+M)/N) times (1.25 times in the example shown in FIG. 4) as large as the frequency of the horizontal synchronizing signals HSYNC. However, the frequency of the horizontal clock CL1 is increased further so as to shorten the interval between pulses thus ensuring the operational margin of the pixels array. In this case, a pulse oscillating circuit is provided to the display control circuit 104 or in the vicinity of the display control circuit 104 and the frequency of the horizontal clock CL1 is increased in conjunction with the reference signal having frequency higher than frequency of a dot clock DOTCLK contained in video control signals generated by the pulse oscillating circuit.

With respect to the respective factors which have been mentioned heretofore, it is preferable to set N to the natural number of 4 or more and M to 1. Further, it is preferable to make the factors Y and M have the same value and to make the factors Z and N have the same value.

<<Second Embodiment >>

Also in this embodiment, in the same manner as the above-mentioned first embodiment, with respect to the video data which is inputted to the display device shown in FIG. 3 at the timing of FIG. 2, the display signals and the scanning signals are outputted from the data driver 102 in waveforms shown in FIG. 1 or FIG. 4 and are displayed in accordance with the display timing shown in FIG. 6. However, in this embodiment, the output timing of the blanking signals with respect to the outputting of display signals based on the video data shown in FIG. 1 or FIG. 4 is changed every frame period as shown in FIG. 8.

Figure 8:
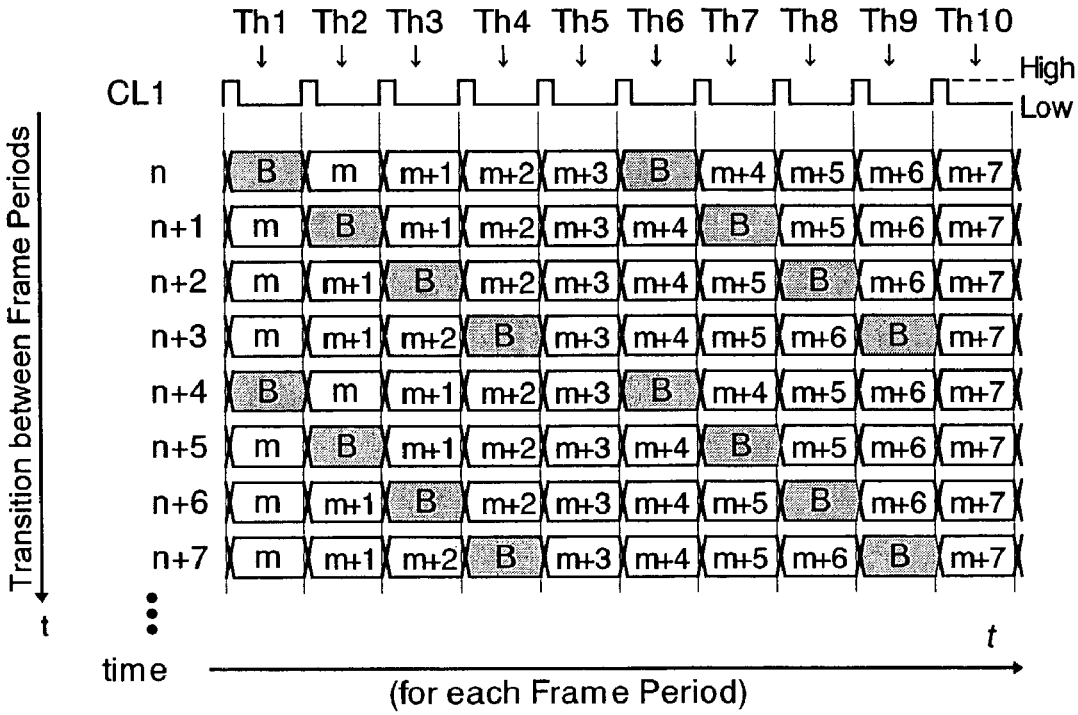
FIG. 8 is a view showing the change of display signals (m, m+1, m+2, . . . derived from video data and B derived from blanking data) which are respectively supplied to pixel rows corresponding to the gate lines G1, G2, G3, . . . over a plurality of continuous frame periods m, m+1, m+2, . . . which are explained in the driving method of the display device according to the second embodiment of the present invention.

In the display device using the liquid crystal display panel as the pixels array, the output timing of the blanking signals in this embodiment shown in FIG. 8 can obtain an advantageous effect of dispersing the influence of dull waveforms of signals generated on the data lines of the liquid crystal display panel to which the blanking signals are supplied whereby the display quality of images can be enhanced. In FIG. 8, times Th1, Th2, Th3, . . . which correspond to respective pulses of the horizontal clock CL1 are sequentially arranged in the lateral direction, while in any one of these periods, the eye diagram including the display signals m, m+1, m+2, m+3, . . . of every one line of the video data and the blanking signals B outputted from the data driver 102 are sequentially arranged in the longitudinal direction for every one of continuous frame periods n, n+1, n+2, n+3 . . . . Here, the display signals m, m+1, m+2, m+3 shown in FIG. 8 are not limited to the specific lines of the video data and can correspond to the display signals L1, L2, L3, L4 as well as L511, L512, L513, L514 shown in FIG. 1, for example.

When the blanking data is written in the pixels array one time for each of four times the video data is written in the pixels array in the manner described in conjunction with the first embodiment, the applying of the blanking data to the pixels array shown in FIG. 8 is sequentially changed from any one of groups of periods which are arranged in every four other periods (for example, the group consisting of periods Th1, Th6, Th12, . . . ) in the above-mentioned periods Th1, Th2, Th3, Th4, Th5, Th6, . . . to another group (for example, the group consisting of periods Th2, Th7, Th13, . . . ) every frame. For example, in the frame period n, before the m-th line data is inputted to the pixels array (the display signals based on the line data being applied to the m-th pixel row), the blanking data is inputted to the pixels array (being applied to the pixel row corresponding to a given four gate lines), while in the frame period n+1, after inputting the m-th line data to the pixels array and before inputting the (m+1)th line data to the pixels array, the inputting of the above-mentioned blanking data to the pixels array is performed. The inputting of the (m+1)th line data to the pixels array is performed following the outputting of the m-th line data and the display data based on the (m+1)th line data is applied to the (m+1)th pixel row. The inputting of the respective ensuing line data to the pixels array is also performed such that the display signals based on these line data are applied to the pixel rows having the same addresses (sequence) as the display data.

In the frame period n+2, after inputting the (m+1)th line data to the pixels array and before inputting the (m+2)th line data to the pixels array, the inputting of the above-mentioned blanking data to the pixels array is performed. In the subsequent frame period (n+3), after inputting the (m+2)th line data to the pixels array and before inputting the (m+3)th line data to the pixels array, the inputting of the above-mentioned blanking data to the pixels array is performed. Thereafter, such inputting of the line data and the blanking data to the pixels array is repeated by shifting the inputting timing of the blanking data every one horizontal period and such an inputting returns to the inputting pattern of the line data and the blanking data to the pixels array according to the frame period n at the frame period n+4. By repeating a series of these operations, when not only the blanking signals but also the display signals based on the line data are outputted to respective data lines of the pixels array, the influence of the dullness of signal waveforms of these signals which may be generated along the extension direction of the data lines can be uniformly dispersed so that the quality of images displayed by the pixels array can be enhanced.

On the other hand, also in this embodiment, the display device can be operated at the image display timing shown in FIG. 6 in the same manner as the first embodiment. However, since the timing for applying the blanking signals to the pixels array is shifted every frame period as described above, a point of time that the second pulse of the scanning start signal FLM which starts the scanning of the pixels array with the blanking signals is shifted in response to the frame period. In accordance with the fluctuation of the second pulse generation timing of the scanning start signal FLM, the time Δt1 indicated in the frame period 1 shown in FIG. 6 becomes the time Δt1' which is shorter (or longer) than the time Δt1 in the succeeding frame period 2, and the time Δt2 indicated in the frame period 1 becomes the time Δt2' which is longer (or shorter) than the time Δt2 in the succeeding frame period 2. To take into consideration the "shifting" of the scanning start time of the pixels array with the display signals based on the line data m observed in a pair of frame periods n and n+1 and another pair of frame periods n+3 and n+4 shown in FIG. 8, at least one of two time intervals Δt1, Δt2 which correspond to the pulse intervals of the scanning start signal FLM is fluctuated in response to the frame period in this embodiment.

As described above, when the display operation which follows the image display timing shown in FIG. 6 is performed in accordance with the driving method of the display device according to this embodiment which shifts the outputting period of the blanking signals in the time axis direction every frame period, although a slight change is necessary for setting the scanning start signals thereof, the advantageous effects obtained by this embodiment are sufficiently comparable to the advantageous effects obtained by the first embodiment shown in FIG. 7. Accordingly, also in this embodiment, the images corresponding to the video data can be displayed on the hold-type display device substantially in the same manner as the impulse-type display device. Further, due to the hold-type pixels array, it is possible to display the moving images without deteriorating the brightness and in a state that a blurring phenomenon of the moving images is reduced. Also in this embodiment, the ratio between the display period of video data and the display period of blanking data during one frame period can be suitably changed by the adjustment of timing of the scanning start signal FLM (for example, the distribution of the above-mentioned pulse intervals Δt1, Δt2). Further, a range in which the driving method of this embodiment is applicable the display device is not limited, in the same manner as the first embodiment, by the resolution of the pixels array (for example, the liquid crystal display panel). Still further, according to the display device of this embodiment, in the same manner as the display device of the first embodiment, by suitably changing the ratio of the retracing period included in the horizontal period defined by the horizontal clock CL1, the number N of outputting the display signals in the first step and the number Z of gate lines selected by the second step can be increased or decreased.

In the method according to the present invention for intermittently inserting periods for inputting the blanking data into the pixels array in the periods for inputting the video data amounting to one frame period to the pixels array, the video display and the blanking display using the pixels array are completed within one frame period (or within a period corresponding to the frame period) without deteriorating the brightness at the time of image display and, further, a blurring of moving images which is generated in a series of video displays over the frame periods and the deterioration of images attributed to the blurring phenomenon of moving images can be reduced. Still furthermore, when the present invention is applied to the liquid crystal display device, by optimizing the ratio between the video display period and the blanking display period during one frame period based on the characteristics of the liquid crystal response speed and the like, it is possible to achieve both of the effect of the reducing the blurring phenomenon of moving images and the advantageous effect of maintaining the display brightness which have a trade-off relationship in the image display using the pixels array.

What is claimed is:

1. A display device comprising:

a pixel array including a plurality of pixels;

a plurality of first signal lines;

a plurality of second signal lines;

a first driving circuit to output scanning signals to the plurality of first signal lines;

a second driving circuit to output display signals to the plurality of second signal lines; and a display control circuit to output a scanning start signal to the first driving circuit, wherein the first driving circuit repeats a first step of sequentially selecting N lines of the plurality of first signal lines and a second step of selecting Z lines of the plurality of the first signal lines, wherein the second driving circuit repeats outputting N times the display signals and outputting 1 time a blanking signal which masks an image displayed on corresponding pixels, and wherein a scanning start signal determines a first time to start the first step and a second time to start the second step.

2. A display device according to claim 1, wherein a period between the first time and the second time is longer than a period between the second time and a time to start the first step of a next frame period.

3. A display device according to claim 1, wherein a first pulse which corresponds to the first time and a second pulse which corresponds to the second time are generated on the scanning start signal at every frame period.

4. A display device according to claim 3, wherein the number of lines in said N lines and the number of lines in said Z lines are the same.

5. A display device according to claim 4, wherein the number of N lines and the number of Z lines are set to 4.

6. A display device according to claim 3, wherein the Z lines of the plurality of the first signal lines are selected simultaneously.

7. A display device according to claim 3, wherein the pixel array is a liquid crystal display panel and the blanking signal is a voltage signal which minimizes the light transmissivity of a liquid crystal layer of the liquid crystal panel.

8. A display device according to claim 1, wherein a first period between the first time and the second time of a first frame period is different from a second period between the first time and the second time of a second frame period which is next to the first frame period.

9. A display device according to claim 8, wherein the number of lines in said N lines and the number of lines in said Z lines are the same.

10. A display device according to claim 8, wherein the number of N lines and the number of Z lines are set to 4.

11. A display device according to claim 8, wherein the Z lines of the plurality of the first signal lines selected simultaneously.

12. A display device according to claim 8, wherein the pixel array is a liquid crystal display panel and the blanking signal is a voltage signal which minimizes the light transmissivity of a liquid crystal layer of the liquid crystal panel.

13. A display device according to claim 1, wherein the number of line in said N lines and the number of lines in said Z lines are the same.

14. A display device according to claim 13, wherein the number of N lines and the number of Z lines are set to 4.

15. A display device according to claim 1, wherein the Z lines of the plurality of the first signal lines are selected simultaneously.

16. A display device according to claim 1, wherein the pixel array is a liquid crystal display panel and the blanking signal is a voltage signal which minimizes the light transmissivity of a liquid crystal layer of the liquid crystal panel.

* * * * *